US011772252B2

(12) United States Patent
Hurley

(10) Patent No.: US 11,772,252 B2
(45) Date of Patent: Oct. 3, 2023

(54) MULTI-PURPOSE HAND TOOL SYSTEM, METHOD OF USE, AND METHOD OF MANUFACTURE

(71) Applicant: Edward P Hurley, Overland Park, KS (US)

(72) Inventor: Edward P Hurley, Overland Park, KS (US)

( * ) Notice: Subject to any disclaimer, the term of this patent is extended or adjusted under 35 U.S.C. 154(b) by 225 days.

(21) Appl. No.: 17/226,888

(22) Filed: Apr. 9, 2021

(65) Prior Publication Data

US 2021/0316436 A1 Oct. 14, 2021

Related U.S. Application Data

(60) Provisional application No. 63/008,308, filed on Apr. 10, 2020.

(51) Int. Cl.
*B25F 1/04* (2006.01)
*B44D 3/10* (2006.01)
*B44D 3/16* (2006.01)

(52) U.S. Cl.
CPC ..... *B25F 1/04* (2013.01); *B44D 3/105* (2013.01); *B44D 3/162* (2013.01)

(58) Field of Classification Search
CPC ... B25F 1/04; B25F 1/02; B25F 1/006; B44D 3/162
USPC ..... 7/118, 158, 163, 167, 168, 105
See application file for complete search history.

(56) References Cited

U.S. PATENT DOCUMENTS 6,131,222 A * 10/2000 Anderson ..... B25F 1/02 7/128
6,453,564 B1 * 9/2002 Foley ..... A62B 3/005 30/367
7,269,867 B2 * 9/2007 Karlstedt ..... B44D 3/162 7/164
8,312,580 B2 * 11/2012 Lee ..... B26B 11/00 7/118
11,253,987 B2 * 2/2022 Levand ..... E04F 21/165
2002/0178875 A1 * 12/2002 Lin ..... B25F 1/04 81/437
2020/0171642 A1 * 6/2020 Newman ..... B25F 1/04

* cited by examiner

*Primary Examiner* — David B. Thomas
*Assistant Examiner* — Shantese L McDonald
(74) *Attorney, Agent, or Firm* — Law Office of Mark Brown, LLC; Christopher M DeBacker

(57) ABSTRACT

An all-purpose, multi-use touchup tool designed for home, office, and general construction work for producing a pleasant, show-quality finish to the construction project. The system generally includes a multitool having up to ten functional touch-up tasks capable of being performed thereby, including multiple blade edges, brushes, and measuring elements. A holder element can be joined with the multitool to expand the functionality of each. The system could include other touchup tools and elements such as a storage cup, wipes, and additional brushes and sanding elements.

14 Claims, 25 Drawing Sheets

MULTI-PURPOSE HAND TOOL SYSTEM, METHOD OF USE, AND METHOD OF MANUFACTURE

CROSS-REFERENCE TO RELATED APPLICATION

This application claims priority in U.S. Provisional Patent Application No. 63/008,308 Filed Apr. 10, 2021, which is incorporated herein by reference.

BACKGROUND OF THE INVENTION

1. Field of the Invention

The present invention relates to hand tools, and more particularly to a combination multi-tool repair system, which will be used in the home and business for doing minor home repairs, completing large building detailing projects, and maintaining valued assets.

2. Description of the Related Art

A multi-tool generally has one or more tools abutting to and being controlled by a handle. A multi-tool is generally used to apply a predetermined tool to a surface and or apply a material, then smooth the material, coat the material and clean the material around the surface. A control grip could be disposed on the handle for comfort and slip resistance.

Existing multi-tool repair systems could be composed of plastic, metallic (e.g., copper, SS, wood laminate, carbon fiber, aluminum) and or many other composites. A worker often prefers a rigid composite tool (e.g., stainless steel trowel) for tooling a large surface area. They may use a semi-rigid composite tool (e.g., aluminum oxide) to apply an intermediate force to the surface. Then, they could consider a soft composite (e.g., nylon bristle or high-density foam) to seal coat the surface, then resort back to a metallic tool composite to clean the tool. Cleaning accessories would typically have softer composites (e.g., nylon microfiber, paper composite) for soft spiff up chores. In some instances, the worker may prefer an all-purpose composite tool (e.g., polypropylene ("PP"), wood composite, bioplastic, stain resistant stainless steel ("SS"), and other suitable composites) to apply a variety of compatible materials to a surface.

Other common multi-tools repair systems may include a margin trowel, which is equipped with a forward fixed offset tool portion for maintaining forward communication with a rearward orientated control handle. A float trowel is sometimes used to gather a material from a container. Unfortunately, the margin trowel sometimes becomes tipsy and could fall into builder adhesive or jar loose in a confined space. The float trowel is also problematic in tight confines and sometimes has difficulty spooning a material at the bottom of a cup.

A multi-tool repair system may include a swivel mechanism (e.g., ball receiver) mounted to a work head and a handle for controlling a forward orientated work head. When such a hand tool is extended out for use, the work head could accidently bump a corner surface to easily loosen the work head, sometimes far from readjustment. A tool with a misaligned work head could cause stains on a nearby finished surface. Moreover, tool misalignment could cause worker fatigue more rapidly than a swivel adjusted work head.

Sometimes a multi-tool repair system will contain a liquid within a handle to be applied to a surface. In order to s sufficiently transfer the liquid, the worker may be orientated in an awkward position to maintain unnatural control of such a handle.

A hand tool may suitably secure to the attachment, but such an attachment may not suitably lock the hand tool in place. A preferred method to minimize unwanted hand tool movement would be to have the hand tool securely fastened along all three rotational axes of the rack.

A multi-tool system having a two or more tools jockeying for a forward use position with respect to the handle maintaining rearward control also exists. An unintended consequence of such a dual use hand tool, the tool load is generally double at its use end, so as to put undesirable tension on the handle.

What is needed is a simple to use combination multi-tool repair system to complete small home repairs, detail large business facilities, and upkeep other valued assets. A combination multi-tool system would be welcomed if it can be used safely, efficiently, and securely, then help complete a small to large building project safely.

Heretofore there has not been available a system or method for a modular multi-tool system meant to simplify minor home improvement repairs, close-out large building projects, and improve valued assets with the advantages and features of the present invention.

BRIEF SUMMARY OF THE INVENTION

A first objective of the present invention is to provide a combination multi-tool system for home and business repairs. The invention provides a first multi-tool and a second multi-tool meant to combine together in "many-in-one" hand tool modular exercises.

A second object of the present invention is to provide the system a plurality of tool accessories (e.g., trowel, sander, brush, scrubber, sponge) for saving back-and-forth time when gathering hand tools.

A third object of the present invention is to provide the system one suitable ergonomic orientated handle with respect to one of many predetermined tool tips (e.g., scraper/razor, straightedge, ruler, pointed caulk tool, V scraper, notched tip, abrading tool, razor) providing suitable use when applying a material to a surface.

A fourth object of the present invention is to provide the system a float trowel when the separable multi-tools are attached for easy float balance of the system on a level patch surface.

A fifth object of the present invention is to provide the system one or more containers (e.g., PPE, hand tools, tool accessories, coating, paste, cleaning wipes, recyclable bags, waste bins, carts and other modular supplies) meant to encourage safety, organization, and tidiness.

A sixth object of the present invention is to provide the system additional reuse shim options when the multi-tools become worn or damaged, which would otherwise go to recycling or waste.

The preferred embodiment may also include a non-absorbent container element with a tray and lid which may also serve as a protective brush cover. The tray can then be used to house a small amount of paint, spackle, putty, grout, or other material which is used during the touchup process.

The brush element may contain a ferrule with multi-directional receiver with two or more latches for retaining an end of the blade within the ferrule. This would allow the user to use the first multi-tool and or the second multi-tool as a handle for the brush. A similar arrangement could be used in conjunction with the scrubbing element.

The first and second multi-tools may attach detach to from a cog to join a pair of blades to form a protractor for use.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Touchup Tool System 2

Figure 1:
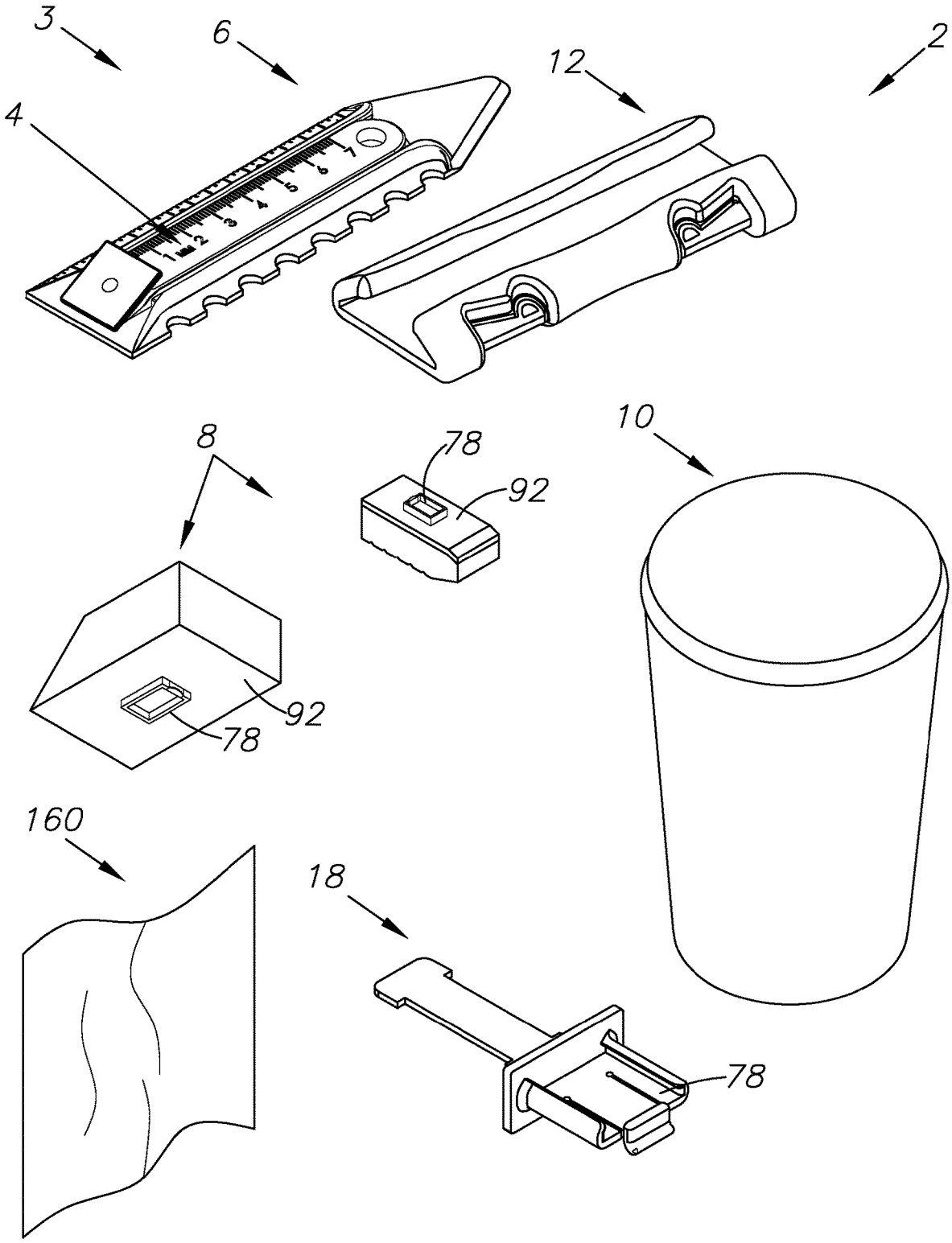
FIG. 1 is a three-dimensional view of the elements embodying a preferred embodiment of the present invention.

A combination hand tool system 2 for home and business repairs of the present invention is illustrated generally at FIG. 1, and preferably comprises a first multi-tool member 4 (e.g. a blade-like tool including a thin square, metric ruler, mixing stick, dab trowel, bit scraper, thin shim) a second multi-tool member 6 (e.g. a handle-like tool including a standard ruler, putty knife, straightedge, soft scraper, caulk liner, flat trowel, notched trowel, trowel float, ruler, rake, placer, rake, thick shim), a tool accessory 8 and/or at least one storage container member 10. As shown, the storage container member 10 is a cup with a lid, but multiple cups and lids would likely be included with a single kit. The system 2 is effective for minor home repairs, detailing large building projects and upkeep of other valued assets.

The first multi-tool 4 includes an edge portion 60 (e.g., a top 62, bottom 64, front 68, right 70, back 72, and left 74 edge portion) to centrally form a handle 28 portion and outwardly provide a shank 30 portion and/or a head 32 portion. The handle 28 could have an interior channel 56 shaped and sized to contain a tool bit 58 (e.g., stir stick, door hinge shim, plastic or SS razor) which could be reused when worn as a small shim.

The two multi-tools 4, 6 can be slotted together into a single multi-tool element 3. The multi-tools 4, 6 could comprise any suitable size, composite (e.g., polypropylene ("PP"), stainless steel ("SS"), copper, titanium, aluminum oxide, wood, wood composite, bioplastic, metal, rubber, polyurethane foam, nylon, carbon fiber, glass reinforcement, UV coating, etc.) and attach or nearly attach together using one or more coupling mechanisms (e.g., injection mold, weld, spring release, adhesive, rivet, clip, bayonet, ball swivel, rails) and other mechanisms known in the art. Preferably, the system 2 wraps together with compatible materials (e.g., PP, polyurethane foam, paper stock, AlO2) known and approved in the art.

PP is a safe all-purpose composite alternative because it is compatible with many building materials found in the EPA Substance Compatibility Chart. PP repels many materials while 10% glass reinforcement adheres the material momentarily, in order to suitably apply a material to a surface therefrom. Not only is PP affordable and easily recyclable, it can also be used as mold regrinds without compromising the performance of the used materials. PP won't rust, splinter or waterlog. Wood composite, SS, titanium, carbon, bamboo, bioplastic, and other approved tool composites could be used. Tool accessory 8 members and storage containers 10 could be any approved size, shape and composite known in the art. The combined system 2 could be sold as individual separable units 4, in order to accommodate loss of components and more affordable use and reuse of the system 2.

Figure 2:
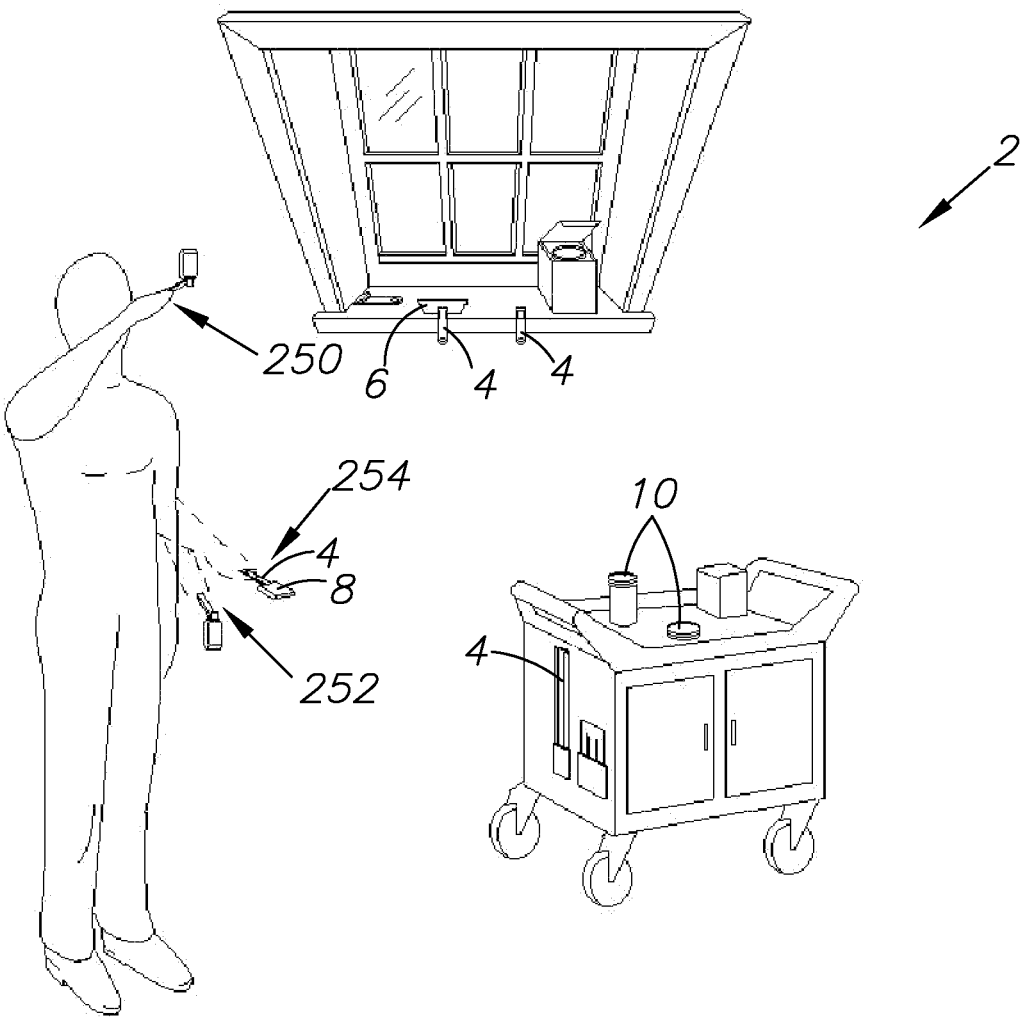
FIG. 2 is a three-dimensional view of an embodiment of the present invention shown in a typical environment.
Figure 3:
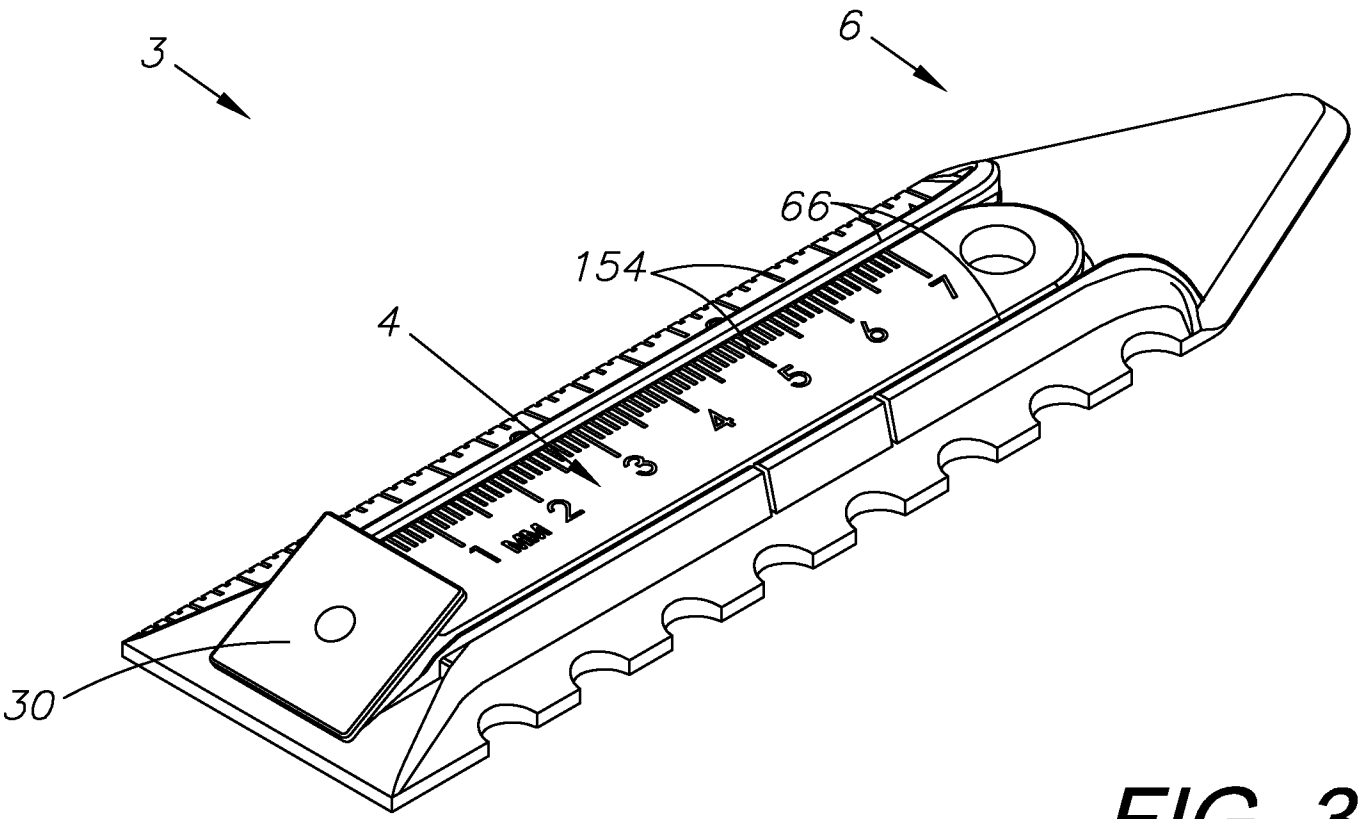
FIG. 3 is a three-dimensional isometric view of a multi-tool and multi-tool holder element of the present invention shown connected in a first orientation.
Figure 4:
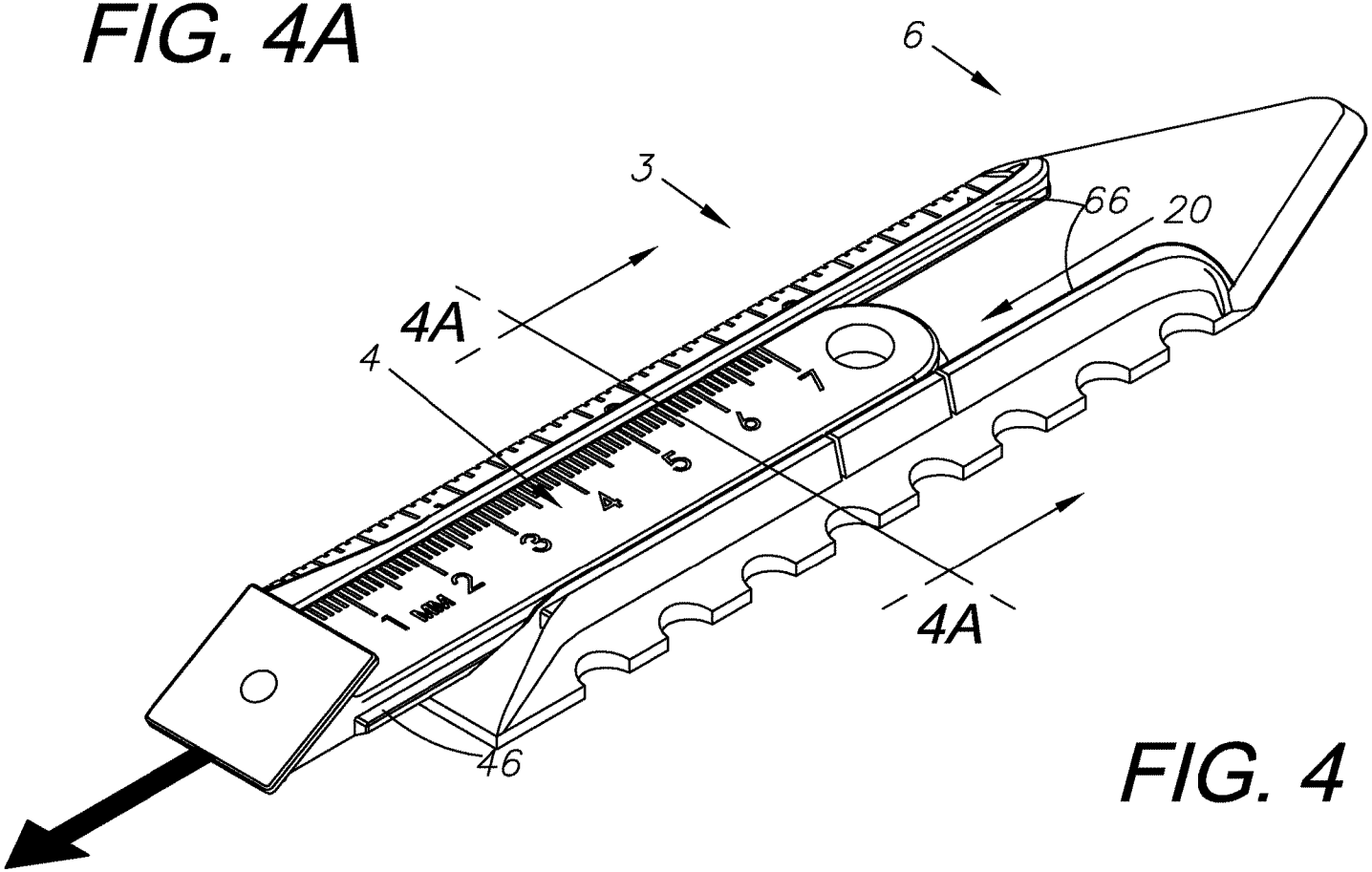
FIG. 4 is a three-dimensional isometric view thereof showing the multi-tool holder element being drawn from the multi-tool element.
Figure 4A:
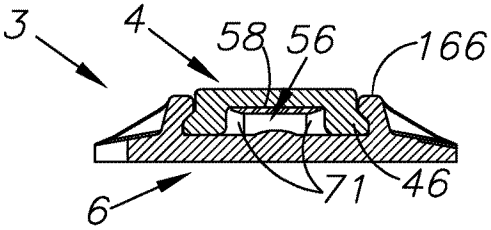
FIG. 4A is a side sectional view taken about the line of FIG. 4.
Figure 5:
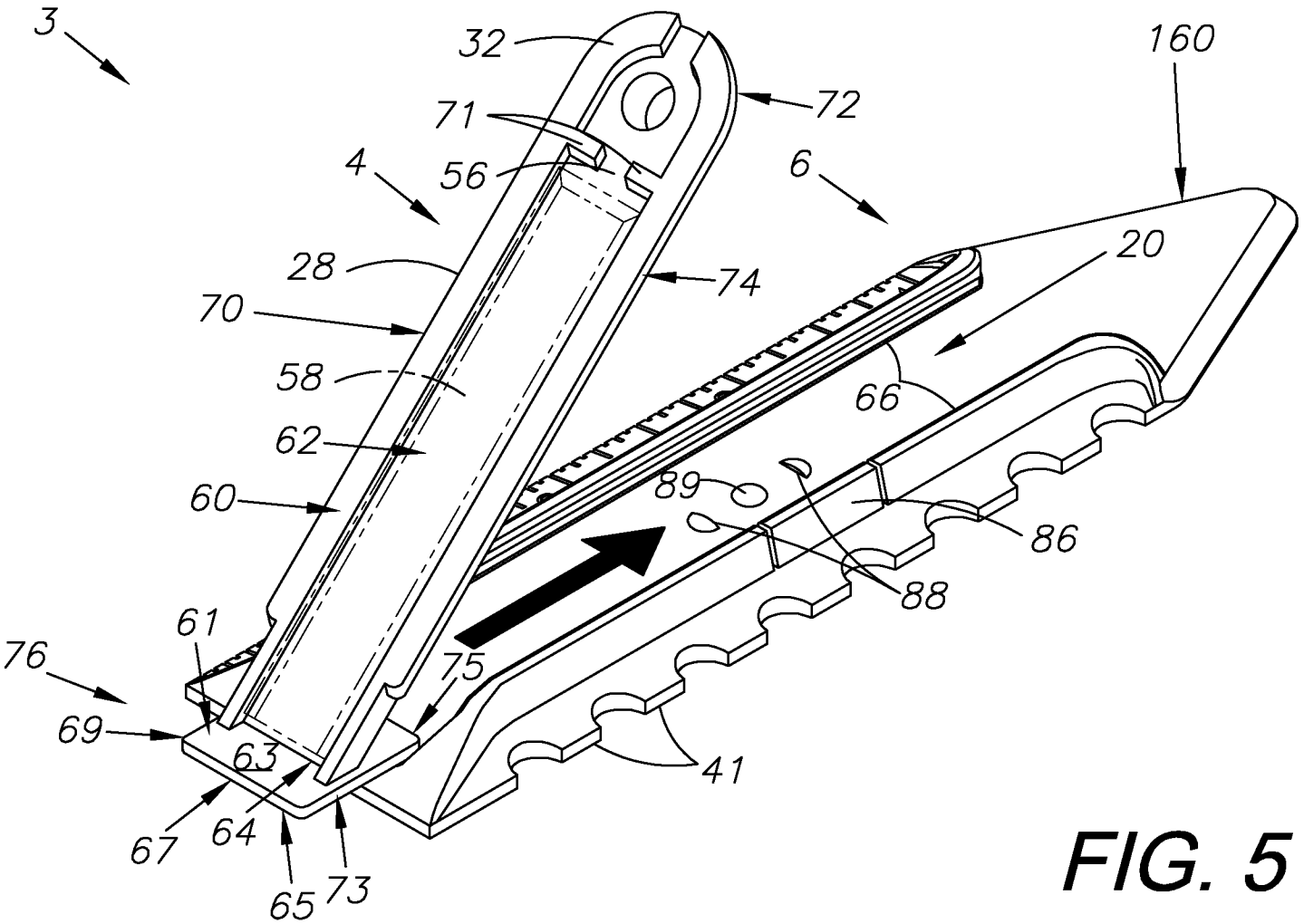
FIG. 5 is a three-dimensional isometric view thereof showing the multi-tool element and the multi-tool holder element as separated.

FIG. 2 shows an embodiment of the present invention as deployed in a typical environment. Here, a user is shown holding a multi-tool 4 in connection with the multi-tool 4 holding an accessory 8 and performing an upper-surface technique 250 for applying material to an upper surface. Referring in more detail to FIGS. 2-5, the hand position is ergonomically affected by the multi-tool 4 such that the handle 28 could be grasped with its top face 62 facing upward to maintain rearward longitudinal orientated control end movements (e.g., forward, backward, sideward) when a tool tip 54 at a leading edge of the first multi-tool, the second multi-tool 6 or the tool accessory 8 maintains forward transverse orientation at its bottom 64 use end, so that the bottom 64 use end can receive a material from a container 10 to suitably apply to the upper surface 250.

Similarly, the handle 28 could be reverse grasped with its bottom face 64 facing upward, so that the tool tip of the shank 30 of the first multi-tool 4, the second multi-tool 6 or the tool accessory 8 bottom 64 orientates in a forward use mode to apply the material to a low surface using a low-surface technique 252. The handle 28 could also be reverse grasped with its bottom face 64 facing upward with respect to the tool tip of the head 32 of the first multi-tool 4 when rotated to a forward position on the handle 28. To that end, the tool tip of the first multi-tool, the second multi-tool 6 or the tool accessory 8 is maintaining forward transverse orientation at its front 64 use end, so that the tool tip at the front 64 use end can apply a material from a container 10 and suitably apply it to a central surface using a central technique.

A generalized cart or other suitable work space storage or organizer is shown in FIG. 2 having extra multi-tools 4 and containers 10 for storing or disposing of materials. Other tools and accessories are shown within the environment.

Figure 6:
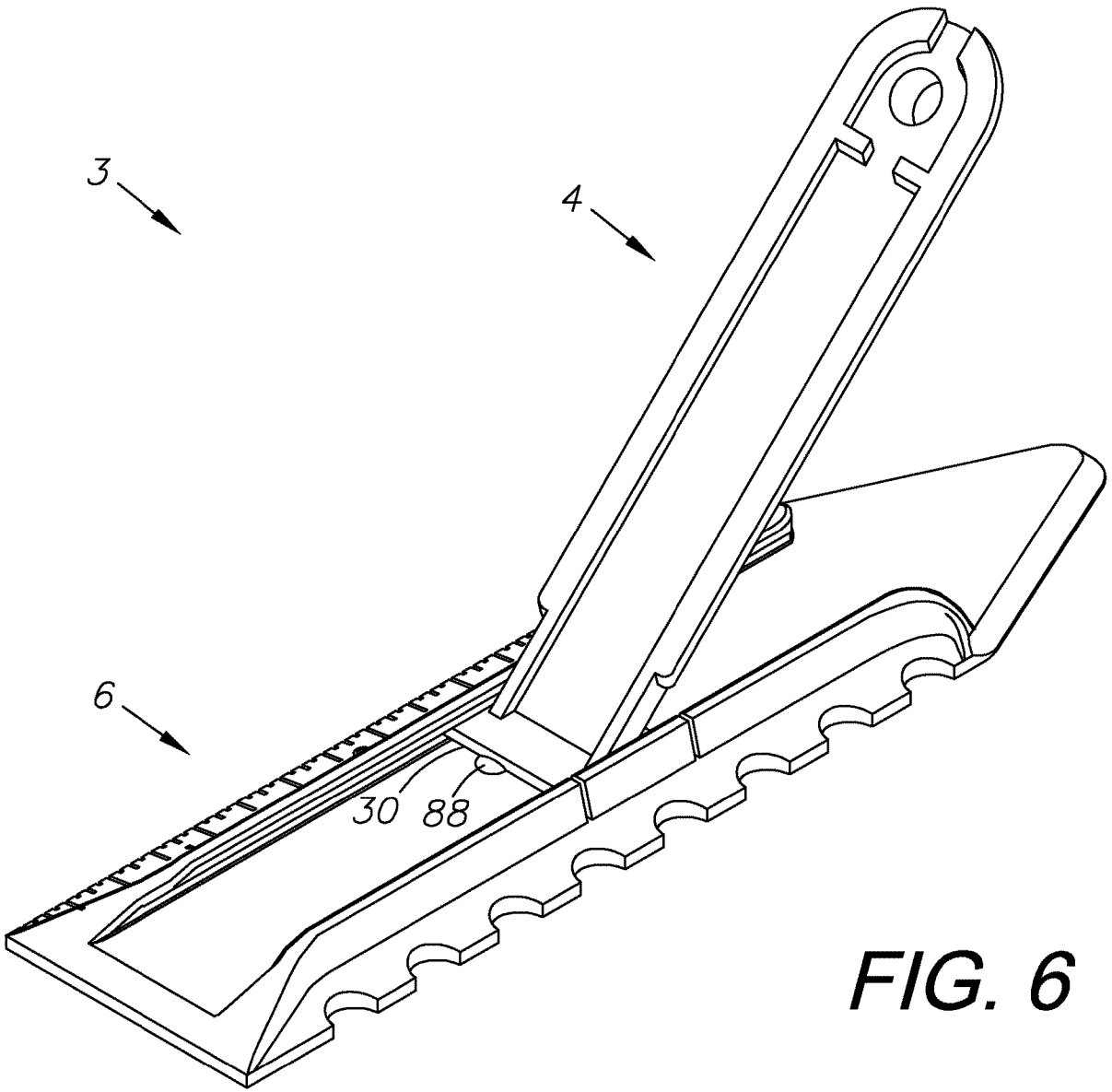
FIG. 6 is a three-dimensional isometric view thereof showing the multi-tool element and the multi-tool holder element connected in second orientation.
Figure 7:
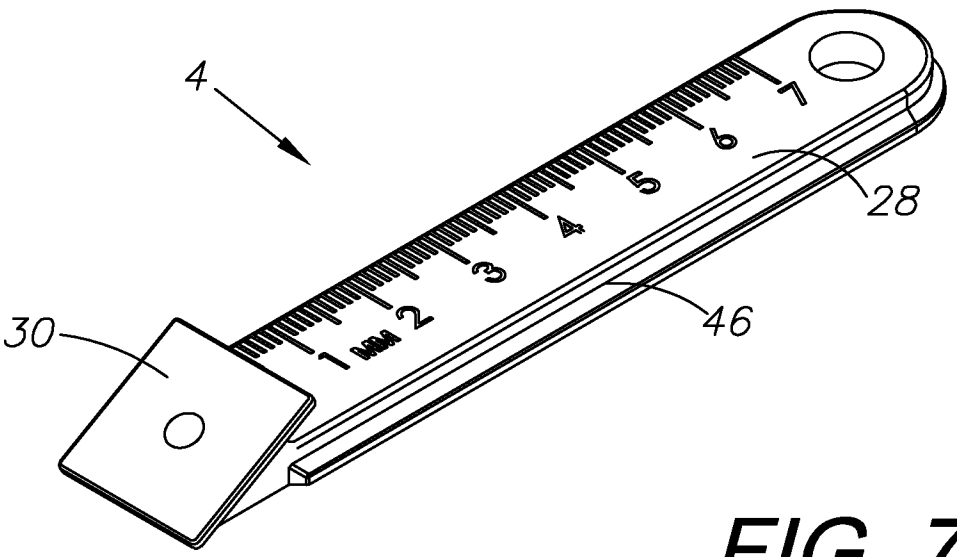
FIG. 7 is a three-dimensional isometric view of the first multi-tool element.

FIG. 3-6 show how the two multi-tools 4, 6 interface and slot together using either the shoulders 46, shown in detail in FIG. 7, of the first multi-tool 4 to slide into the rails 66 of the second multi-tool 6, or alternatively engaging the shank 30 of the first multi-tool 4 with the rails 66 of the second multi-tool 6 and locking the shank 30 within a relief 78 or other connector on the top face of the second multi-tool 6.

The shank 30 includes a shank edge portion 61 (e.g., a top 63, bottom 65, front 67, right 69, back 73 and left 75 edge portion). The shank 30 top 63 could comprise rails (e.g., left and right rails) and the shank front 67 could comprise a beveled edge which could be used as a bit shovel/bit scraper. The shank bottom 65 bisects a longitudinal plane of the handle 28 about its top surface 62, preferably at or about a thirty-degree (30°) angle, meant to maintain the handle 28 in "one-in-many" rearward neutral ergonomic control modes of operation. The first multi-tool 4 could be separated from the larger multi-tool 6, to perform smaller repair tasks.

Figure 8:
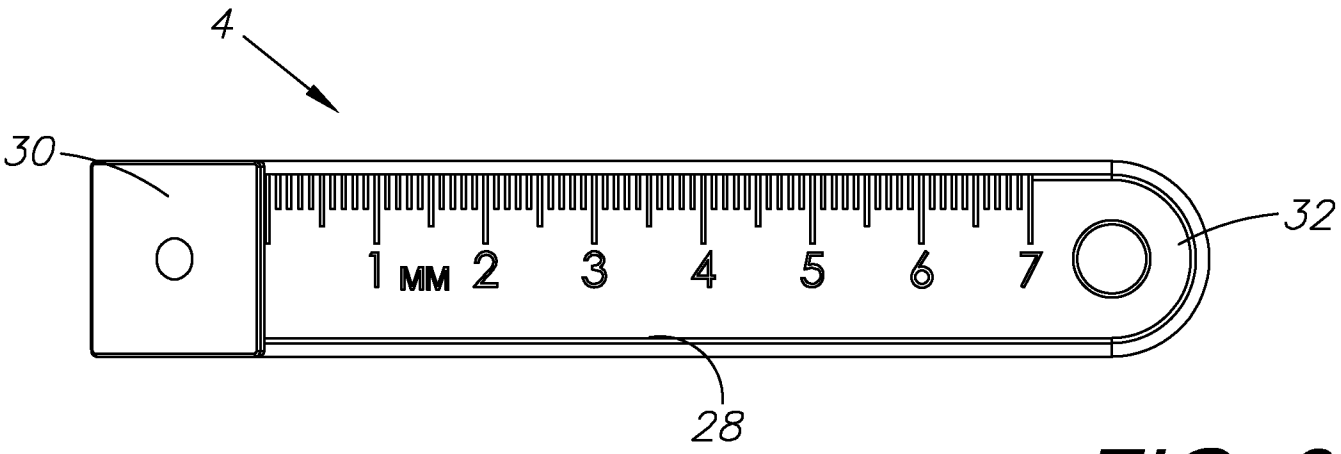
FIG. 8 is a top plan view thereof.
Figure 9:
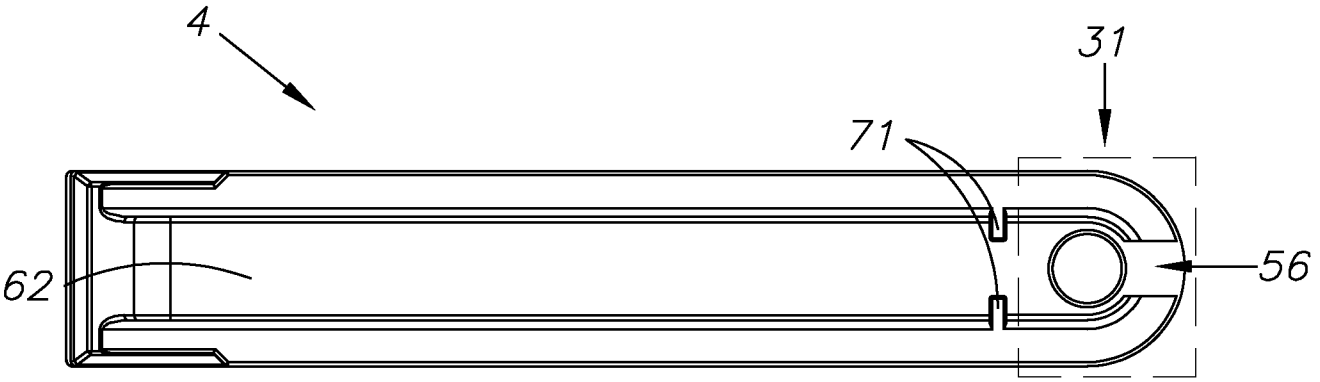
FIG. 9 is a bottom plan view thereof.

FIGS. 7-9 show the first multi-tool 4 in isolation. The handle 28 front edge 68 and the shank 30 back edge 75 perpendicularly bisect, so that the handle 28 will interface with a level or plumb surface simultaneously with said shank 30 interfacing with a plumb or level surface, respectively, for separable use of the first multi-tool 4 thereof. The first multi-tool 4 can be separately used at the shank bottom 65 as a bit mixer or bit trowel.

The back edge 72 of the shank 30 could be seated on a ledge with the handle 28 descending downward, as shown prior in FIG. 1, so as to make a plumb mark with the handle 28 right 70 or left 74 edges. The combined multi-tools 4, 6 could be assembled to modulate into a larger miter square, so that the worker can make square or plumb marks as well as improve building laser marks.

Figure 11:
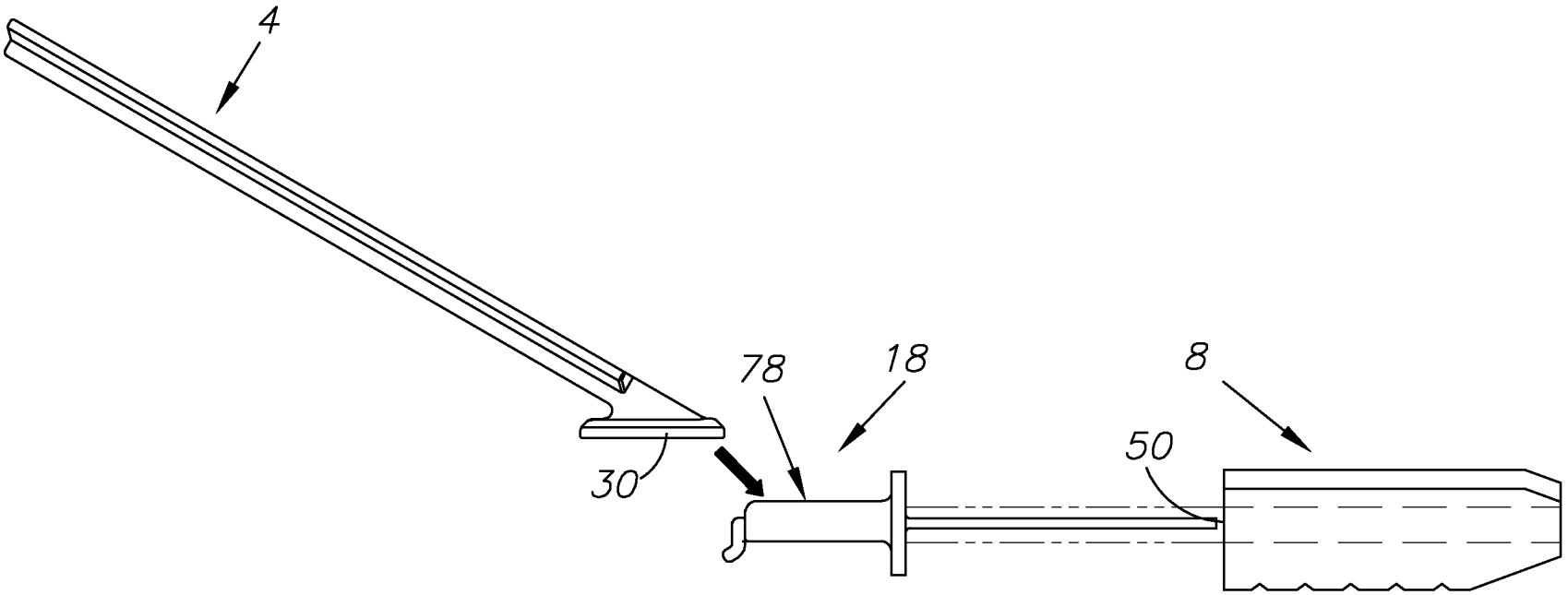
FIG. 11 is a side lavational view thereof shown in use with an adapter element and an accessory element.
Figure 17:
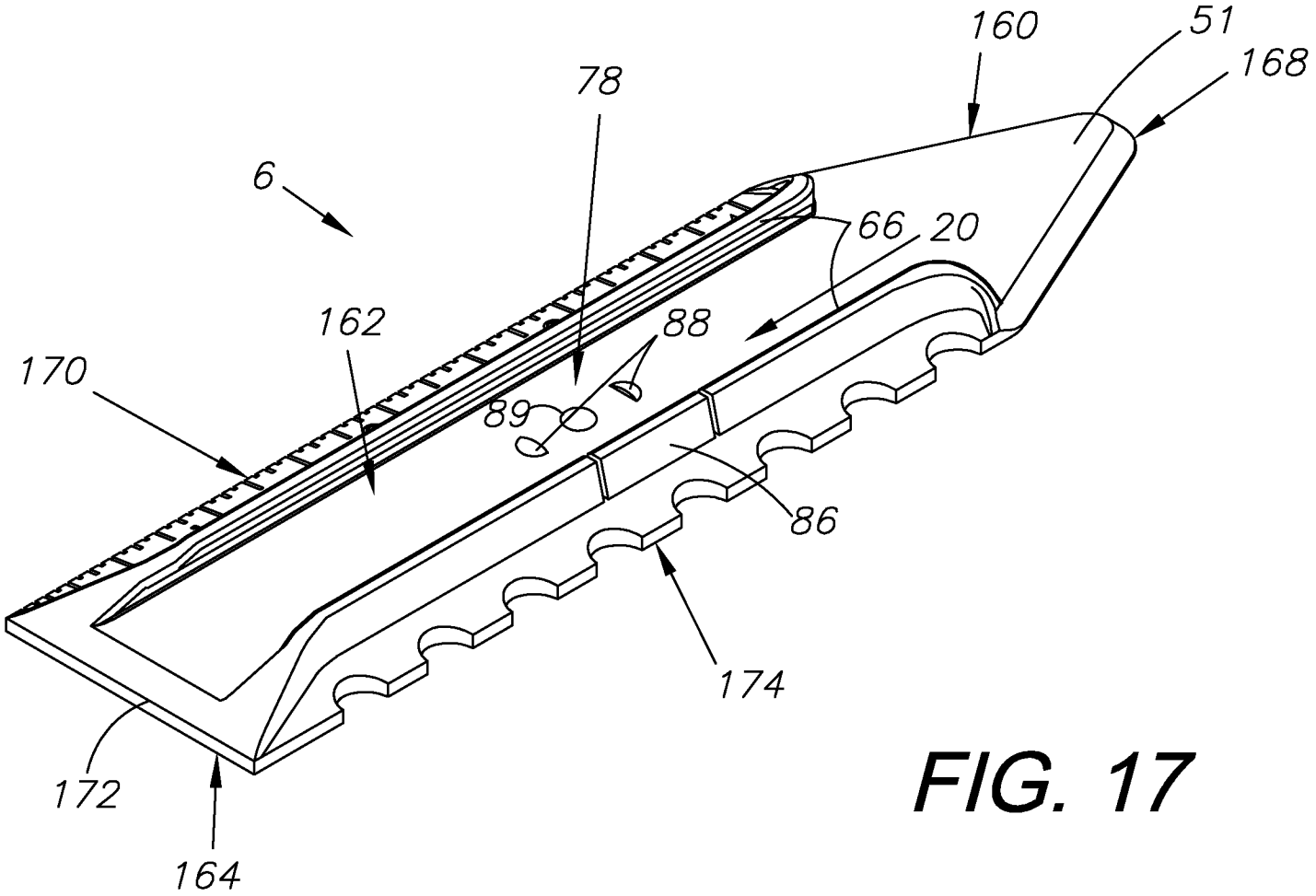
FIG. 17 is a three-dimensional isometric view of a second multi-tool element thereof.

The coupler 76 could be sized and shaped for selectively securing the shank 30 to a relief 78 mechanism (e.g., pivot clip, plunger, etc.) which could be mounted to at least one second multi-tool 6 or at least one side 92 of a tool accessory 8. The tool accessory 8 could comprise an edge portion (e.g., a top, bottom, front, right, back, and left edge portion) to abut or nearly abut at its back edge 112 to the relief 78, as shown in FIG. 11. The second multi-tool 6 top edge 162 could abut or nearly abut to the relief 78, as shown in FIG. 17, so that the first multi-tool 4 handle 28 maintains rearward control of the forward orientated second multi-tool 6 or the tool accessory 8.

The first multi-tool 4 could comprise a shank coupler 30 orientated transverse with respect to longitudinal orientation of the handle 28 and a head coupler 31 orientated longitudinal with respect to the longitudinal orientation of the handle 28 could attach detach to from each second multi-tool 6 and each tool accessory 8 in four unique positions by engagement of the relief 78. The second multi-tool 6 or tool accessory 8 reliefs 78 could include a locking mechanism (e.g., clip 86, stop bumps 88, 89, or other locking mechanisms not shown, including ball swivel, plunger, key, collar, cam, cogwheel, bayonet, snap ring, adhesive, rivet, sleeve, weld, adhesive, clamp, rail, latch, etc.) to abut or nearly abut to the first multi-tool 4 coupler 76 to the second multi-tool 6 in at least one locked use mode of operation. The worker could use one hand to keep the first multi-tool 4 stationary simultaneously with the other hand urging the second multi-tool 6 or the tool attachment to separate the multi-tools 4, 6 and the tool accessory 8. The coupler 76 relief 78 engagement of the multi-tools 4, 6 and the tool accessory 8 will sufficiently restrict system 2 movement to apply a material to a surface.

Figure 8A:
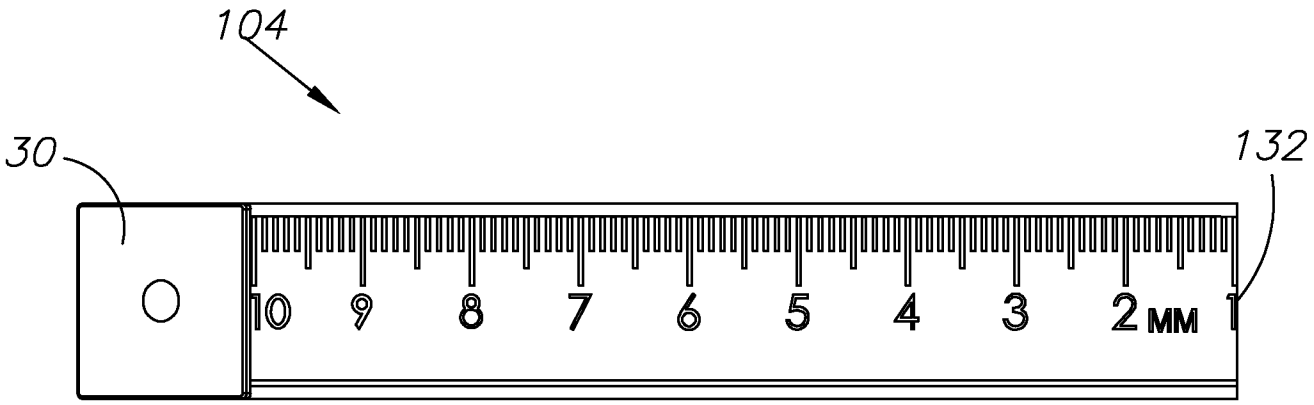
FIG. 8A is a top plan view of an alternative embodiment thereof having a squared head end.
Figure 9A:
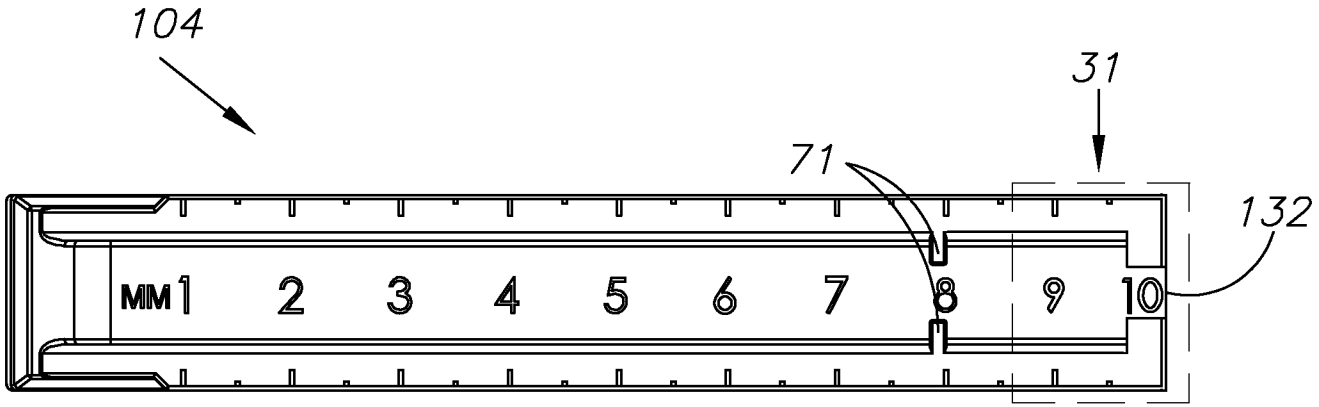
FIG. 9A is a bottom plan view of an alternative embodiment thereof having a squared head end.

FIGS. 8-9 show how the first multi-tool 4 head 32 is rounded, which can be used for some situations, but which also presents an issue with using the hash-marks of the ruler. FIGS. 8A and 9A, in contrast, show an alternative embodiment multi-tool 104 where the head 32 could be square shaped, so as to providing a square edge for facilitating the squaring of a surface and for providing accurate corner measurements.

Figure 10A:
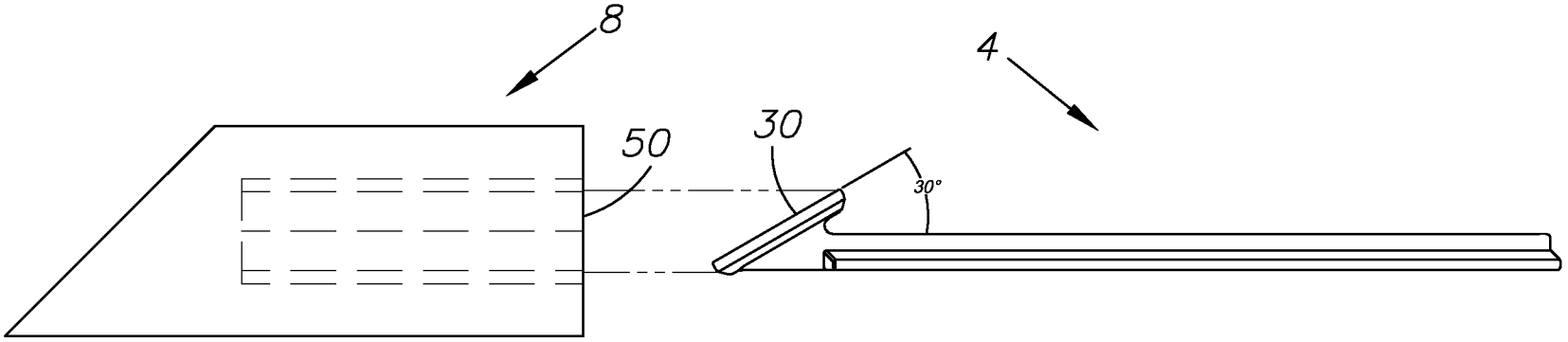
FIG. 10A is a side elevational view thereof shown in use with an accessory element.
Figure 10B:
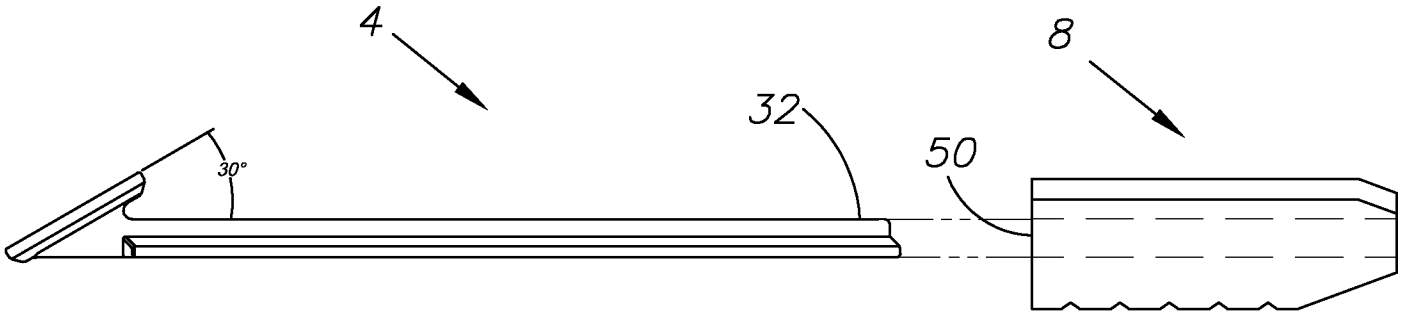
FIG. 10B is a side elevational view thereof shown in use with another accessory element.

FIGS. 10A and 10B show how the first multi-tool 4 can interface with various accessories 8, such as sanding blocks and scrubbing brushes using either the coupler 76 to interface with a relief 50 in the accessor 8 in FIG. 10A, or the head 32 as in FIG. 10B.

Figure 10D:
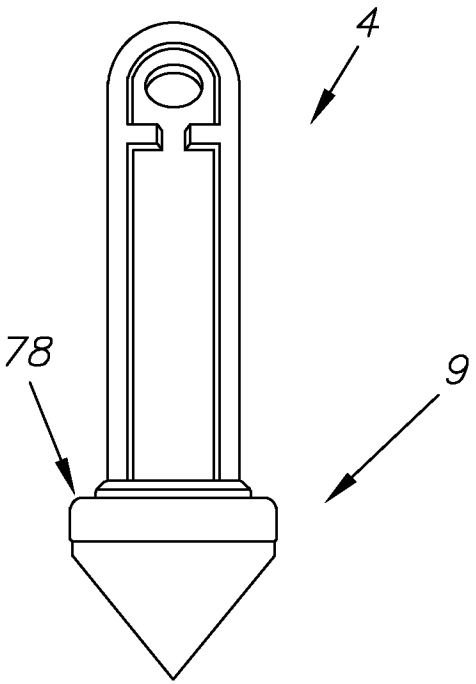
FIG. 10D is a front elevational view thereof.
Figure 10C:
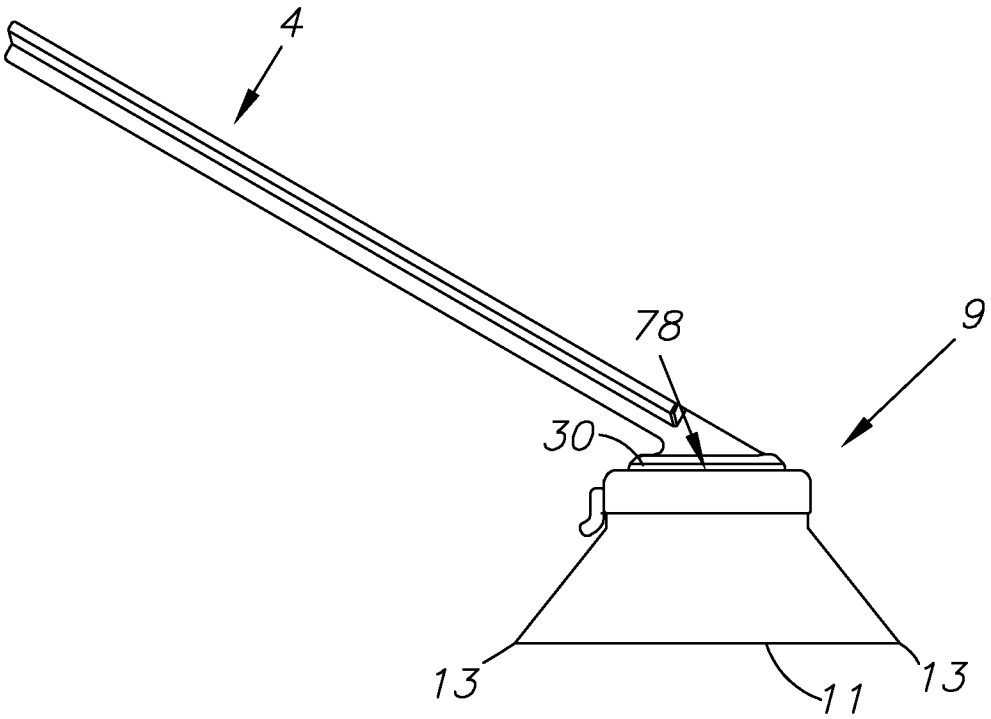
FIG. 10C is a side elevational view thereof shown in use with yet another accessory element.

FIGS. 10C and 10D similarly show a type of adapter which is a scraper adapter 9 including a scraper edge 11 and end points 13. This scraper accessory used with the multi-tool 4 as shown allows the user to easily scrape and remove elements such as caulking or other materials in corners, between tiles, and at other locations with ease and comfort.

FIG. 11 shows a stem adapter 18 meant to abut or nearly abut to the shank 30 of the first multi-tool 4 for use of the tool accessory 8. The stem adapter 18 could include a pair of shoulder stops 71. The head 32 and shoulder stops 71 outline a straight coupler 31 meant to attach detach the head 32 to a tool accessory 8 in coplanar alignment of the handle 28.

Figure 12:
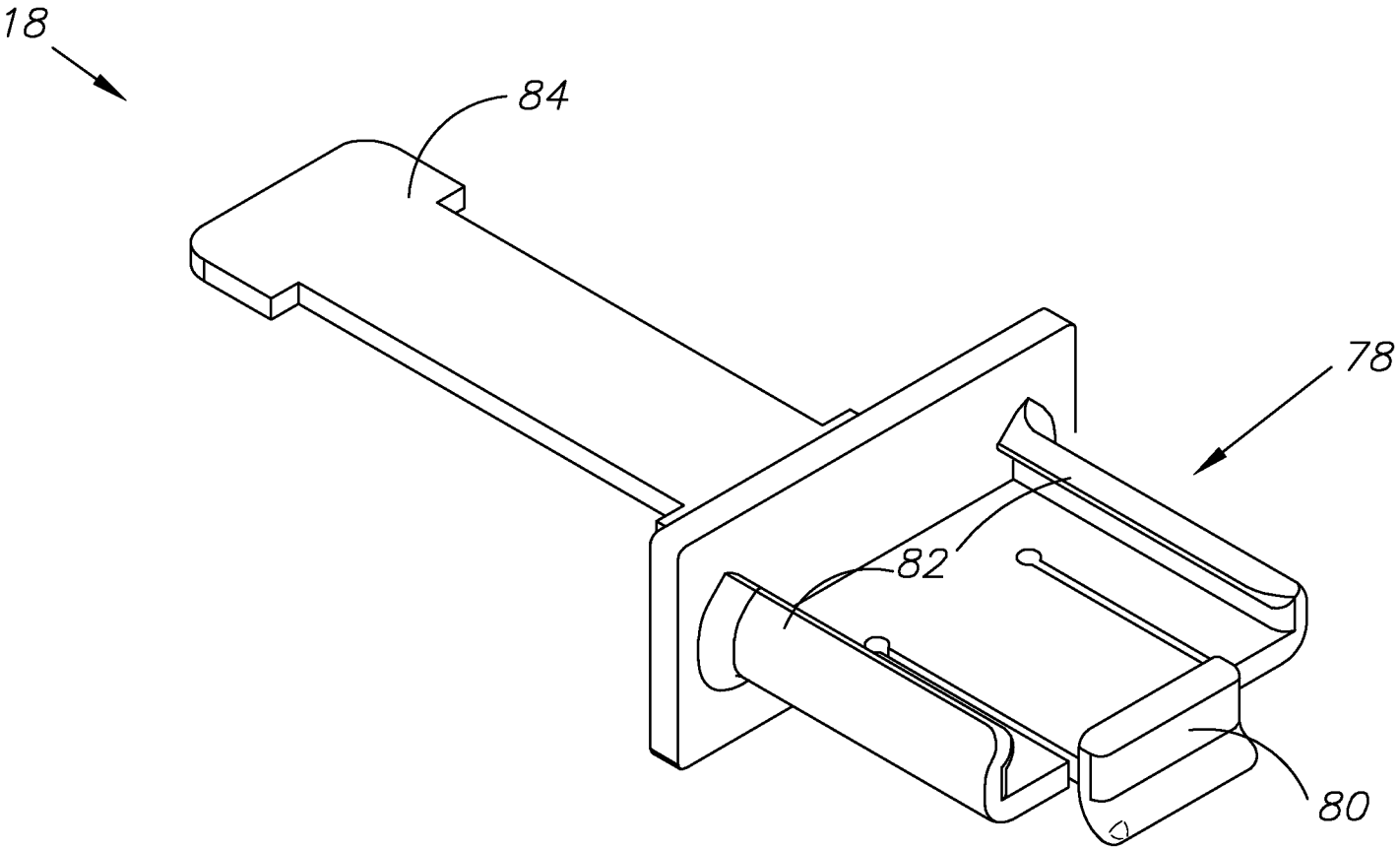
FIG. 12 is a three-dimensional isometric view of a brush adapter element.
Figure 13:
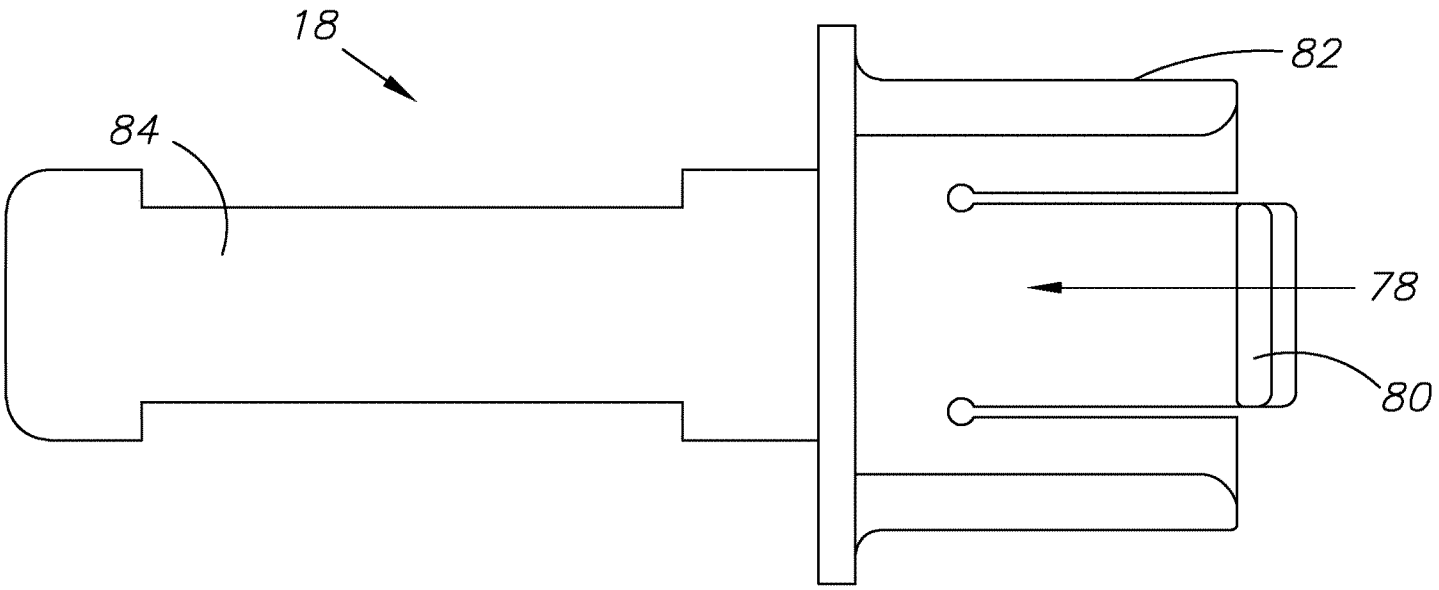
FIG. 13 is a top plan view thereof.
Figure 14:
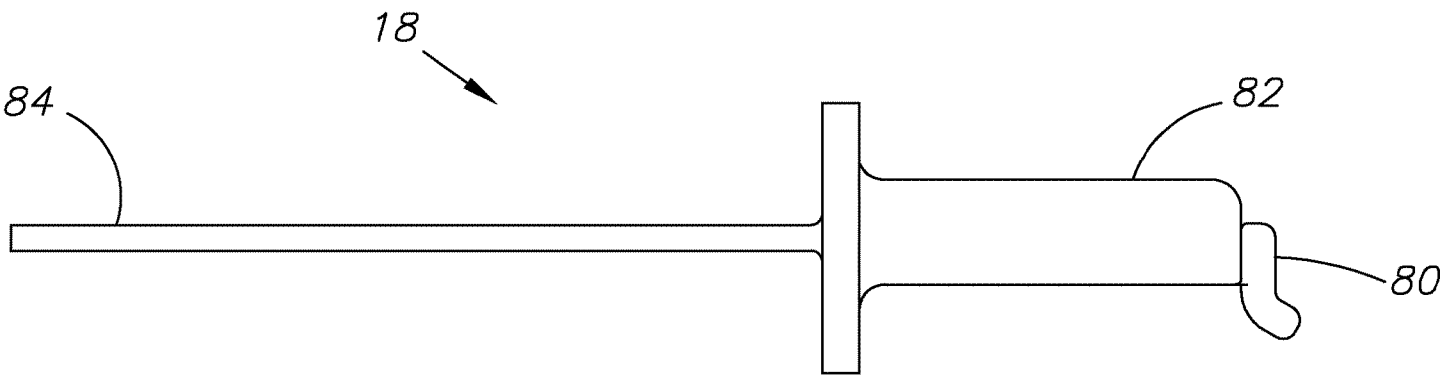
FIG. 14 is a side elevational view thereof.
Figure 15:
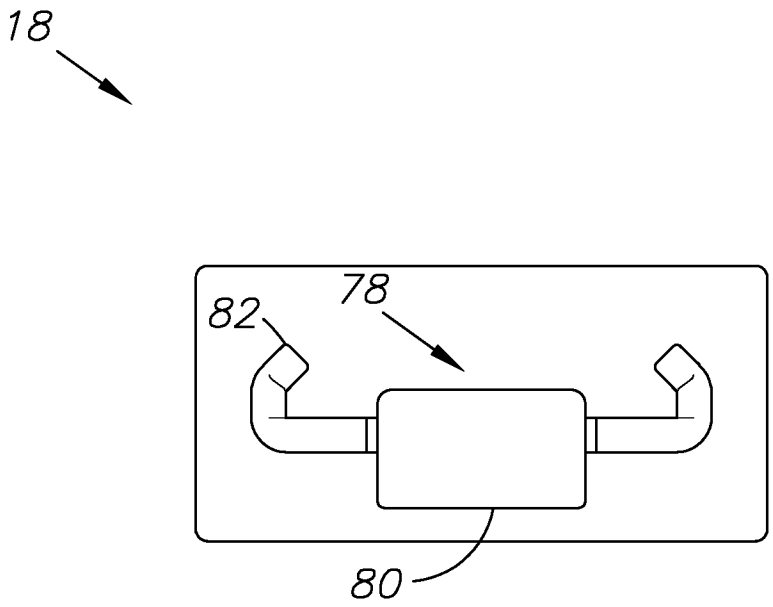
FIG. 15 is rear elevational view thereof.

FIG. 12 shows a tool adapter 18 having the relief 78 extending outwardly opposite a receiver insert 84. The relief 78 will abut or nearly abut to the coupler 30 or head coupler 31, so that the tool tip 54 will sufficiently extend out from the tool accessory 8 to apply a tool edge with or without a coating or material to a surface. The insert 84 could be received in the receiver slot 50 of the tool accessory 8. The relief 78 can be finger pinched by the worker to facilitate separate second multi-tool 6 and tool accessory 8 operations to apply a tool edge with or without a coating or material to a surface in a tightly confined space. The relief may have a pair of rails 82 to further secure the coupler when inserted into the relief 78. A stopper 60 can help prevent material from the accessory 8 from contaminating the multi-tool or the user's hands.

As shown in FIGS. 15-22, the second multi-tool 6 has an edge portion 160 (e.g., a front 168, right 170, back 172, and left 174 edge portion) to outwardly comprise at least one tool tip 54 (e.g., V-scraper, putty spoon, straightedge, ruler, grout scraper, hook knife, back filler, spreader, comber, float, razor, rake, placer, etc.). The second multi-tool 6 top surface 162 could include one or more rails 166 (e.g., a right rail 176 and a left rail 177) to inwardly form a storage channel 20. The storage channel 200 could be used to carry one or more tool bits 58. The second multi-tool 6 could also include a relief 78 equipped with a clip mechanism 86 and a pair of bump stops 88 meant to centrally abut or nearly abut to the shank 30 to bolster the engagement thereto. The clip 86 could include a tab 80 meant to ease attachment detachment of multi-tools 4, 6. The second multi-tool 6 embodiment could be any shape (e.g., flat, grooved, convex, V, lipped spade, pointed, notched, rectangular, square, polygonal, round, smooth or unsmooth).

Figure 16:
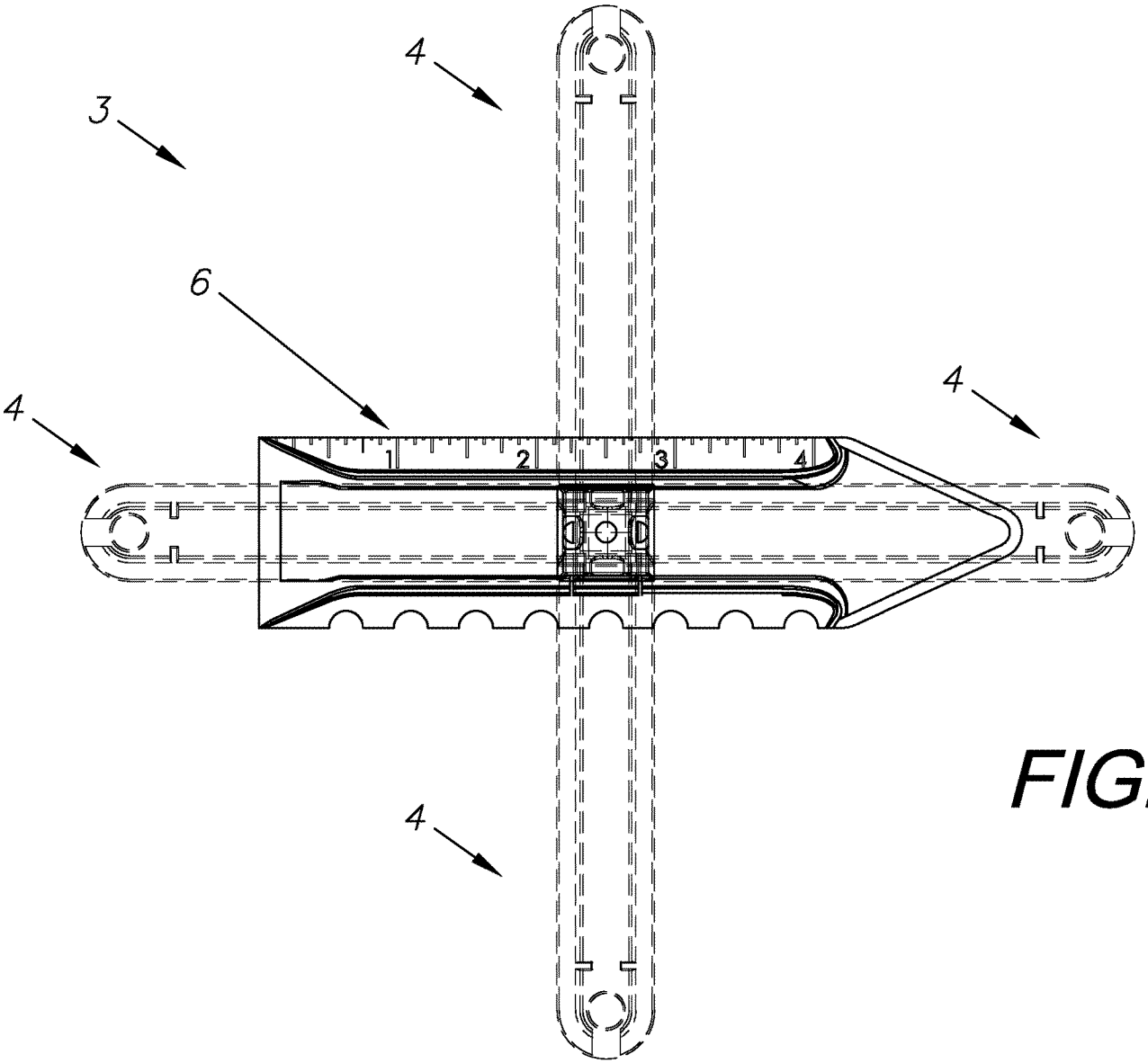
FIG. 16 is a top plan view showing the first multi-tool interfacing with the second multi-tool in multiple orientations.

The second multi-tool 6 relief mechanism 78 is similar to the ones described above for the tool accessories 8. The second multi-tool 6 rails 66 could further form a longitudinal track to receive the first multi-tool 4 therein by equipping the shoulders 76 meant to maintain the multi-tool set 3 in a low profile stow position. The second multi-tool 6 could also comprise a clip 86 mechanism meant to receive the first multi-tool 4 in multiple orientations as shown in FIG. 16 via predetermined engagement of the coupler 76 and relief 78 meant to secure the multi-tool set 3 in multiple transverse forward use modes with respect to the handle 28 maintaining longitudinal rearward neural ergonomic orientation.

Figure 17A:
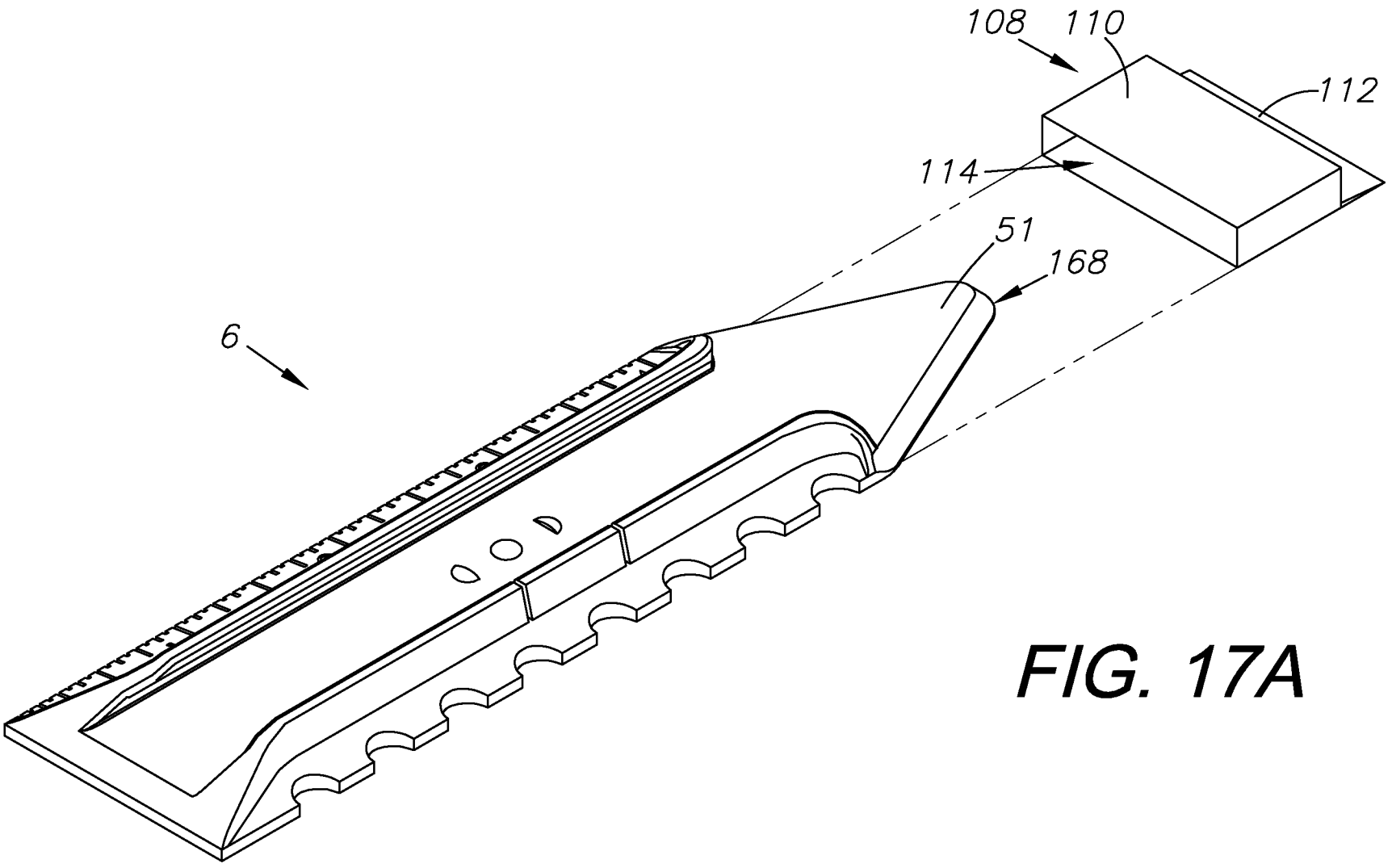
FIG. 17A is a three-dimensional isometric view thereof shown with an optional accessory element.
Figure 18:
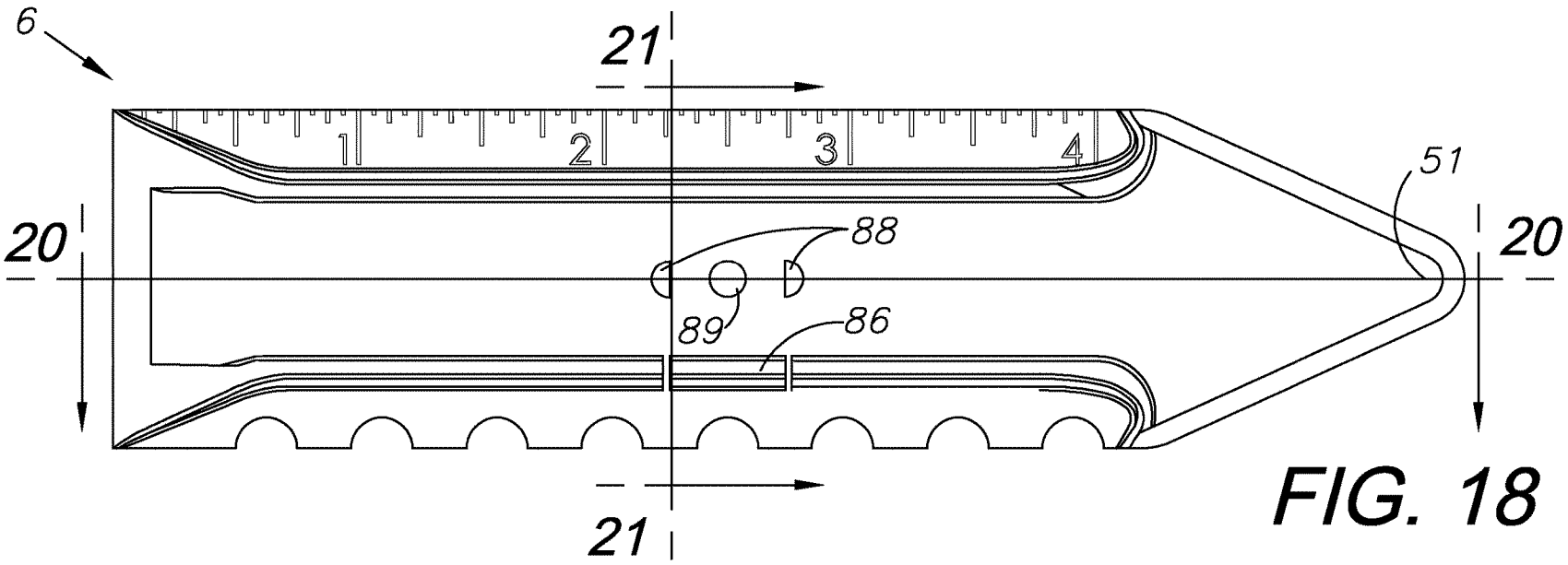
FIG. 18 is a top plan thereof.
Figure 19:
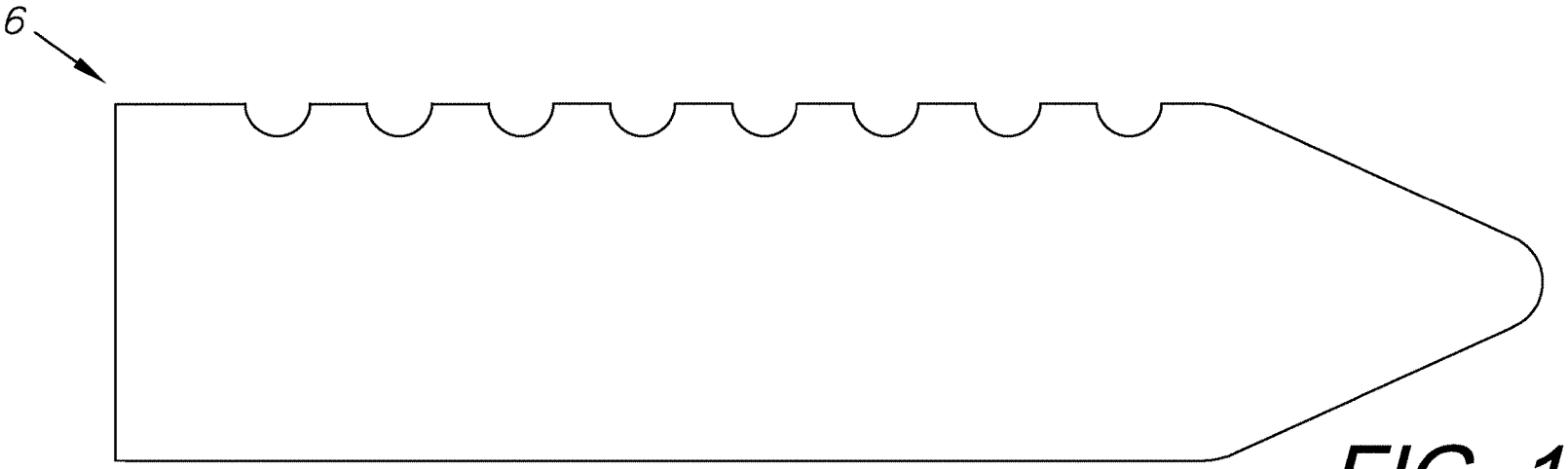
FIG. 19 is a bottom plan thereof.
Figure 20:
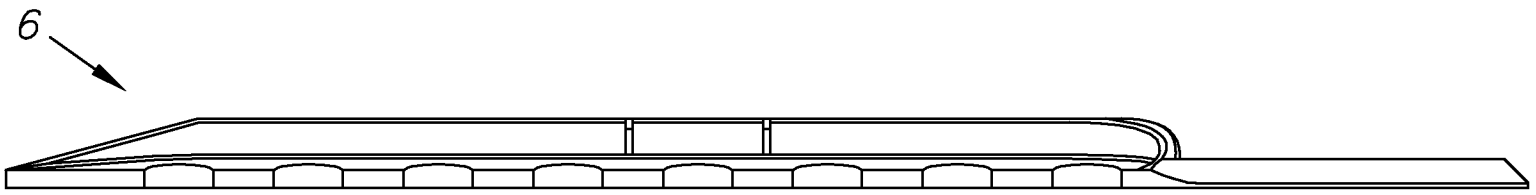
FIG. 20 is a side elevational view thereof.
Figure 21:
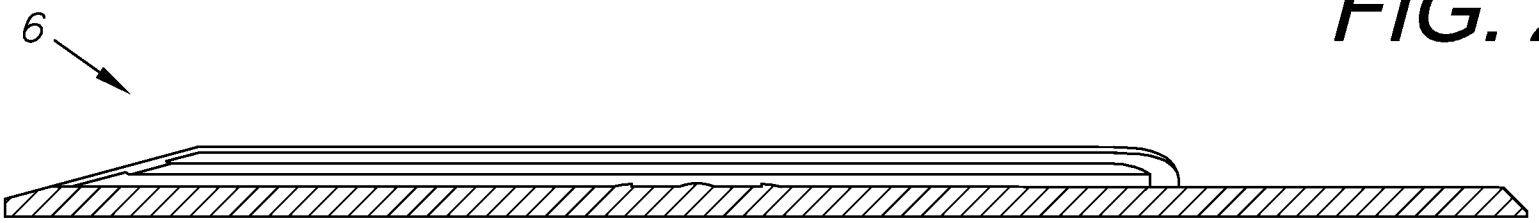
FIG. 21 is a side sectional view thereof taken about the line of FIG. 18.
Figure 22:
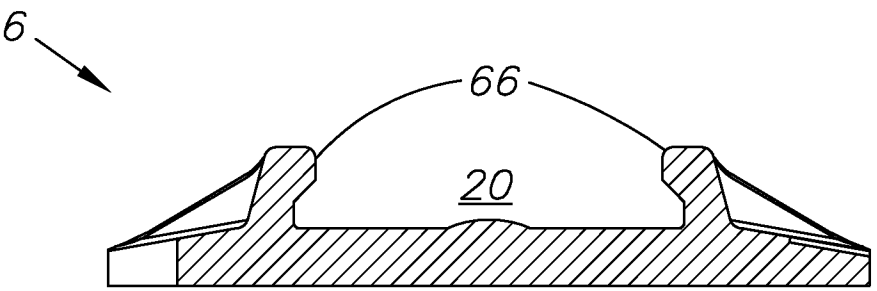
FIG. 22 is a front sectional view thereof taken about the line of FIG. 18.
Figure 23:
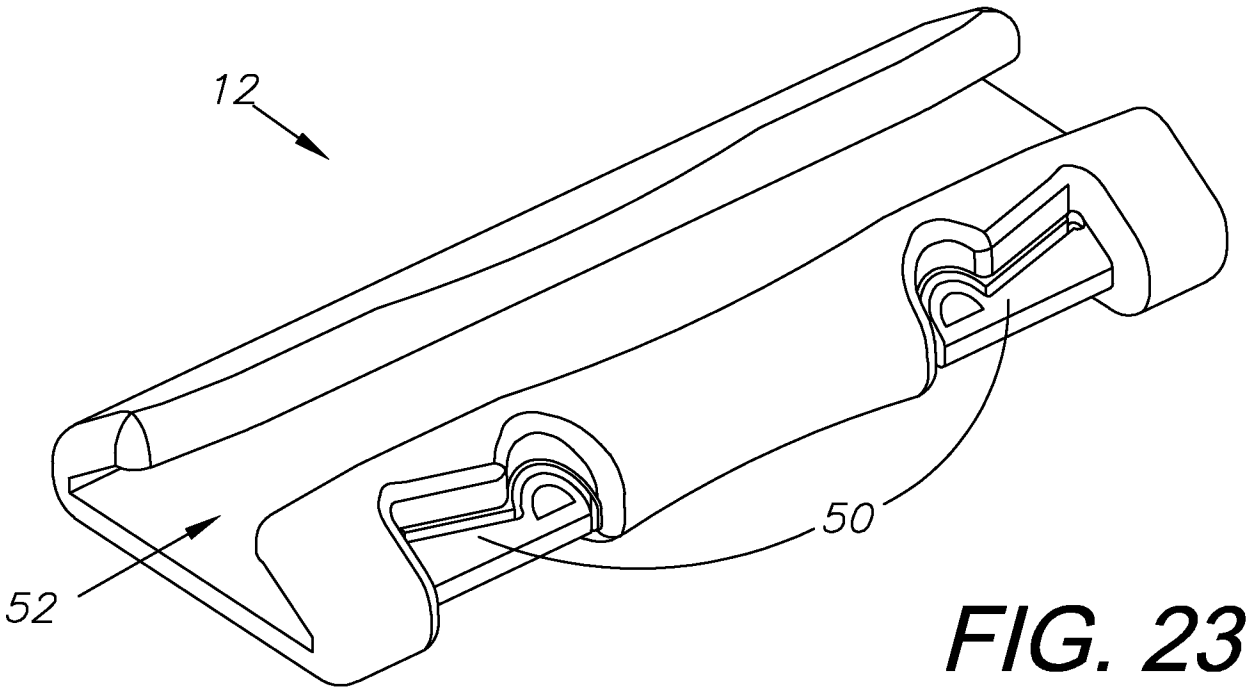
FIG. 23 is a three-dimensional isometric view of a holster element.
Figure 24:
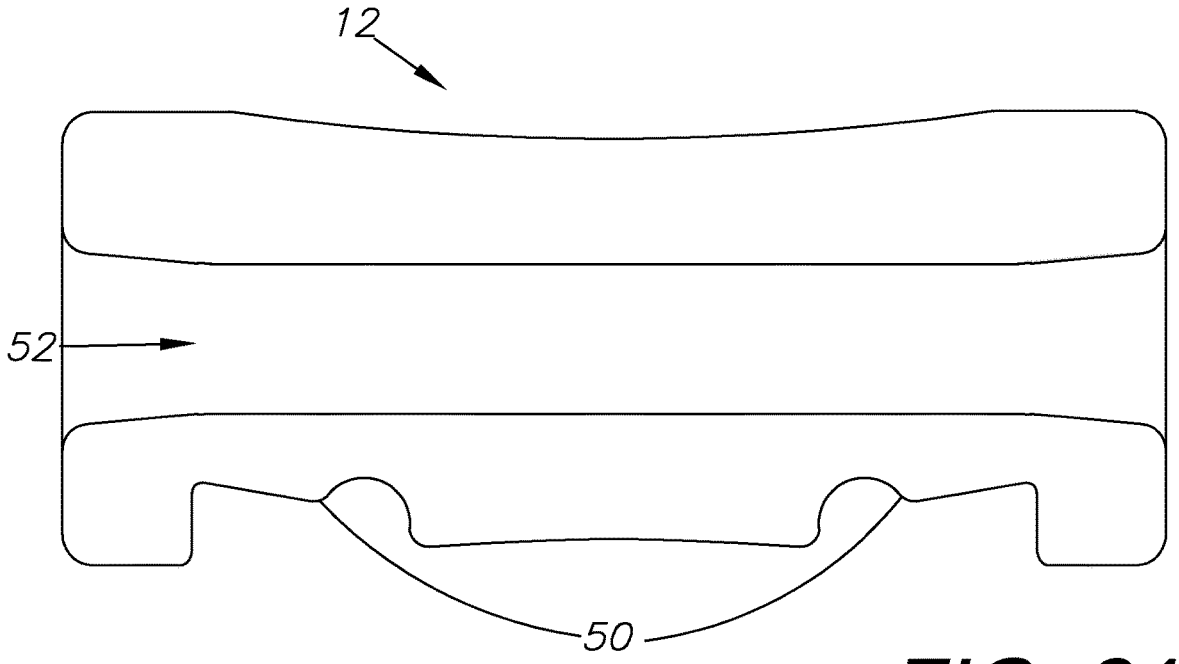
FIG. 24 is a top plan view thereof.
Figure 25:
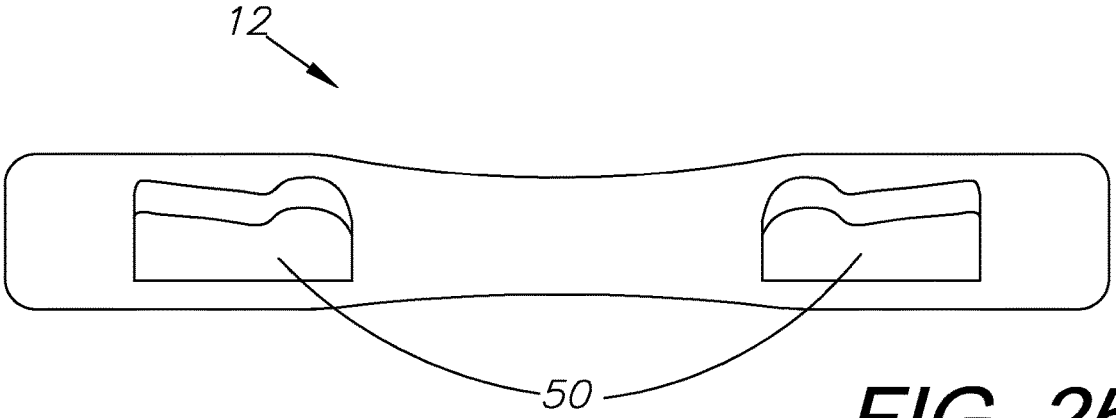
FIG. 25 is a side elevational view thereof.
Figure 26:
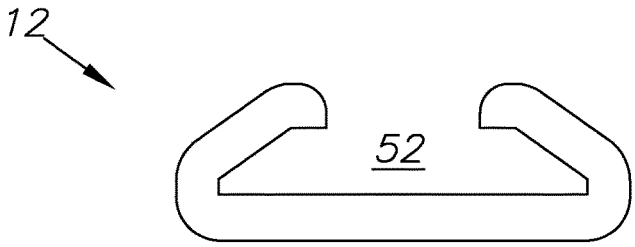
FIG. 26 is a front elevational view thereof.
Figure 27:
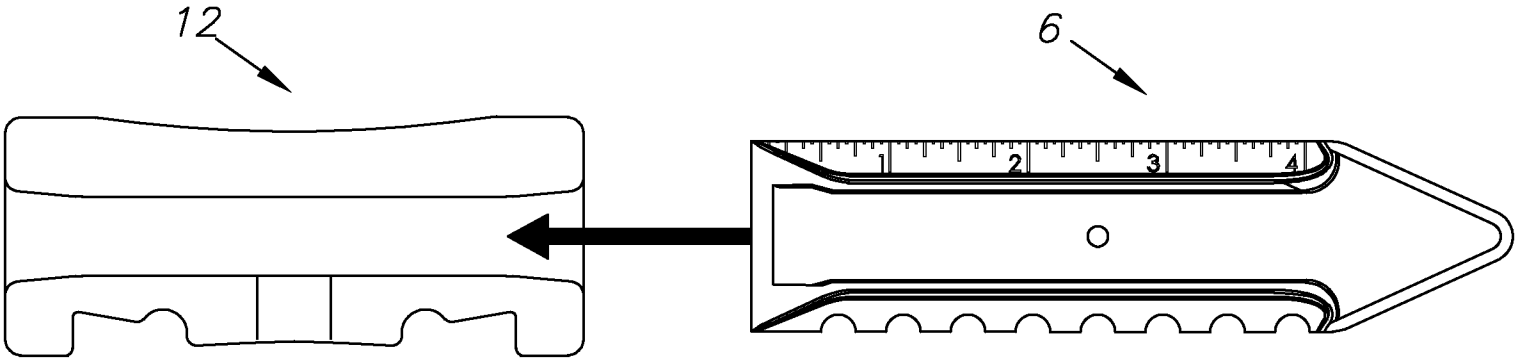
FIG. 27 is a top plan view thereof shown interacting with the multi-tool element.
Figure 28:
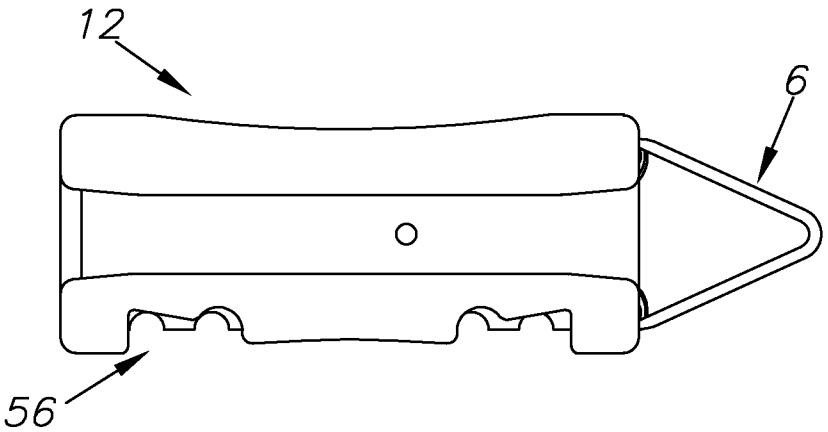
FIG. 28 is a top plan view thereof, showing the multi-tool element stored within the holster element.

FIG. 17A shows a tool tip accessory 108 which may include a storage box 110 with an interior space 114 for being received at the tip 51 of the multi-tool 6. A receiver may be mounted on or around the tip 51, such that the accessory 108 merely clips or is otherwise retained about the tip. The accessory could include a razor blade 112 or other scraper or tool tip enhancement device.

The handle 28 could be grasped with its top face 62 facing upward to maintain rearward longitudinal orientated control end movements (e.g., forward, backward, sideward) with respect to the shank 30, the second multi-tool 6 or the tool accessory 8 bottom 65, 164, 94 maintaining forward transverse orientation at its bottom 64 use end, so that the bottom 64 use end can receive a material from a container 10 to suitably apply a tool, coating or material to an upper surface. The handle 28 could be reverse grasped with its bottom face 64 facing upward, so that the shank 30 bottom 65, the second multi-tool 6 bottom 164 or the tool accessory 8 bottom orientate in a forward use mode to apply the material to a low surface. The handle 28 could also be reverse grasped with its bottom face 64 facing upward with respect to the shank 30, the second multi-tool 6 or the tool accessory 8 maintaining forward transverse orientation at its front 164 use end, so that the tool tip 54 at the front 164 use end can apply a material from a container 10 and suitably apply it to a central surface.

The handle 28 could be grasped with its back face 64 facing forward to maintain rearward longitudinal orientated control end movements (e.g., forward, backward, sideward) simultaneously with the head 32, the second multi-tool 6 or the tool accessory 8 maintaining a forward longitudinal orientated mode of operation, so that the front use end can gather a material from a container 10 and suitably apply it to a central surface. The handle 28 maintains one neutral ergonomic control orientations with respect to the head 32, the second multi-tool 6 or the tool accessory 8 maintaining many modular use orientations.

The multi-tools 4, 6 could be given ruler hash marks 154 meant to be initially used to hold molten composite in place during production of the multi-tools 4, 6, so as to resist warpage. The worker can then use the multi-tools 6 to make more accurate measurements in hard-to-reach building repair gap.

The multi-tools 4, 6 can be combined to detail measure, mark, patch, and paste a surface without smearing the handle 28 as shown in FIGS. 6 and 16. The multi-tools 4, 6 will rest directly on the patch surface to avoid smears on new finishes. Scrap used as underlayment won't be needed as often. Less material is required to go to processing. The rails 66 could be formed from a pair of long narrow mirrored slots (not shown) meant to stow the multi-tools 4, 6 in a compact inactive profile or active reuse profile as dual shims.

When multi-tools 4, 6 are worn they could be reused as backup shims (e.g., proximate ⅛", ¼", 5⁄16th" combined). Accordingly, the shank 30 can be accurately sheared off when wanting to reuse the shank 30 and the handle 28 as a pair of separate backup shims.

At least one container 10 (e.g., cart, bucket, carton, cup, dish, bag) could modulate with other containers, in order to organize workspace. Each container 10 is meant to cover the multi-tools 4, 6 and each tool accessory 8, so as to prevent soiled tools. The container 10 can be wrapped into multiple containers, in order to strengthen the composite during shipment of the product. Thinner, stronger material lowers carbon emissions. For example, one container 10 could be a cup used to contain multi-tools 4, 6 and each tool accessory 8 whereas another container 10 cup could be used to contain a liquid material. A raised lid element could be used to contain liquid content. Each container 10 could comprise one or more compartments 108 to comprise multi-tools, 4, 6, one or more tool accessories 8, and sundries 160 (e.g., spackle, glue, cleaning wipes, sanders, paint brushes) which could be of any number, shape, composite, and filled substance known to the art.

In other embodiments, the multi-tools 4, 6 could comprise a power control handle 12 as shown in FIGS. 23-28, which operates as a holster having an interior 52 space to hold the second multi-tool 6, and further meant to maintain longitudinally orientated control of the multi-tools 4, 6. The power control handle comprises clip 54 mechanism urged to centrally orientate the multi-tools 4, 6 in a compact stow mode when inactive or urged to outwardly orientate the multi-tools 4, 6 in a use mode with the multi-tools 4, 6 or tool accessory 8. The clip mechanism 54 could be any shape or size and lock by any method (e.g., central cylinder, outer cylinder, wedge, ball, bump) known in the art. In the example as shown, the clips 54 engage one or more of the notches 41 of the multi-tool 6.

Figure 29:
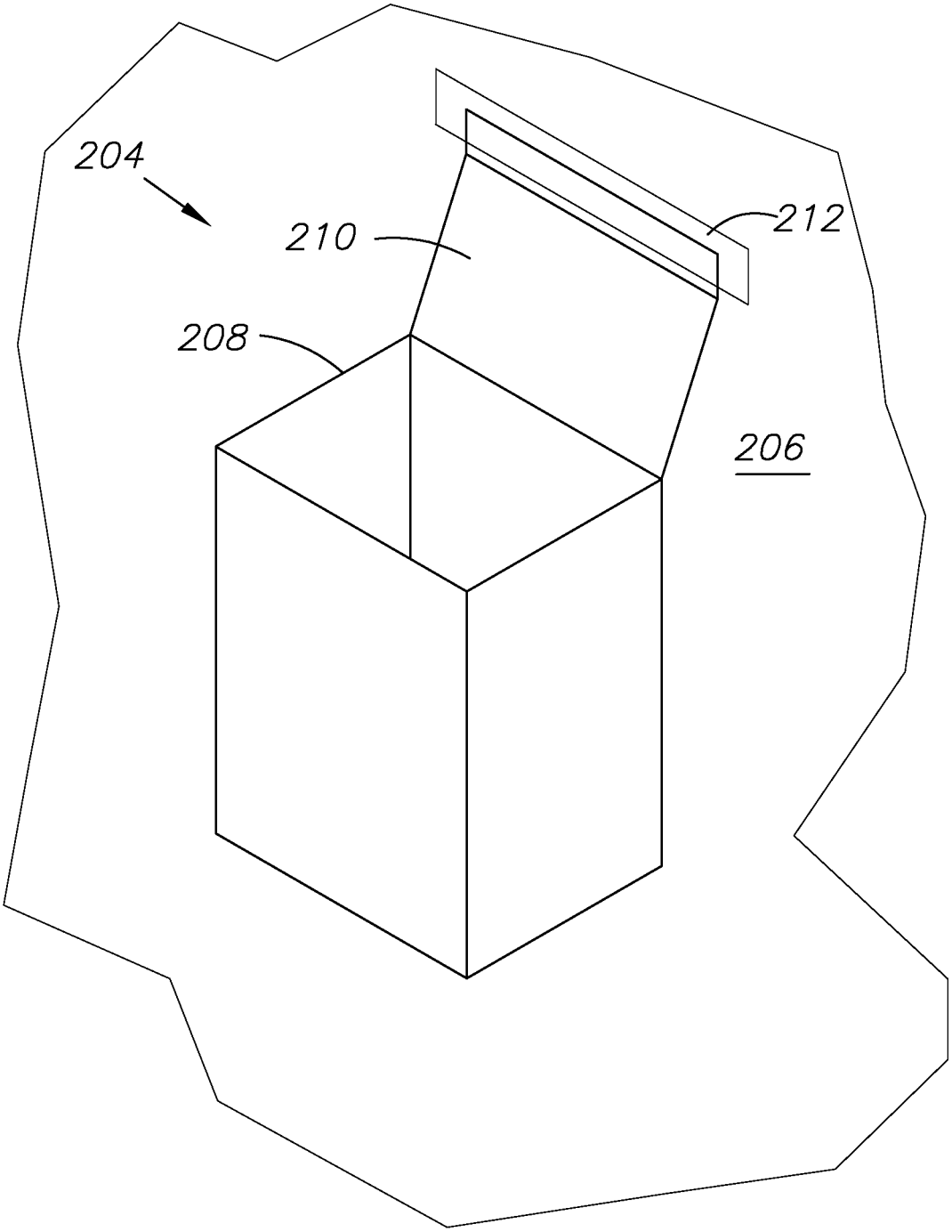
FIG. 29 is a three-dimensional isometric view of a carton system element thereof.

FIG. 29 is a carton system 204 using a carton 208 and a bag lining 210 where a piece of tape 212 or other adhesive or connecting device can be used to secure the carton and bag lining to a surface 206 such that when drilling occurs above the carton system 204 dust is collected within the carton and bag lining.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A combination multi-tool system comprising:

a first multi-tool comprising a handle portion terminating in a head portion at a distal end thereof;

said handle portion terminating into a shank at a proximal end thereof;

said first multi-tool having a surface edge comprising a top face, a bottom face, a front end at said proximal end, a rear end at said distal end, a left side, and a right side;

said shank having a surface edge comprising a top face, a bottom face, a front end, a rear end, a left side, and a right side;

said shank comprising a coupler configured to engage with a relief;

wherein said first multi-tool is configured to selectively temporarily engage with at least one accessory configured for performing work on a building element;

a second multi-tool comprising a surface edge comprising a rear edge, a top face, a bottom face, a left side, a right side, and a front edge forming a tip;

said second multi-tool including said relief configured to receive said coupler of said first multi-tool such that said handle of said first multi-tool is configured to control said first multi-tool and said second multi-tool as a composite tool configured for performing work on a building element;

said second multi-tool comprising a pair of rails configured to guide and secure said coupler into said relief in a first, composite orientation; and said pair of rails further configured to receive said left and right sides of said first multi-tool in a second, stowed orientation.

2. The system of claim 1, wherein said at least one accessory includes said relief.

3. The system of claim 1, further comprising a plurality of hash marks on at least one of said top face and said bottom face of said first multi-tool, said hash marks configured to be used as a measurement tool.

4. The system of claim 1, wherein said shank and said handle form a thirty-degree angle.

5. The system of claim 1, wherein said handle maintains rearward orientated longitudinal control function with respect to said shank maintaining forward orientated transverse control function for said first multi-tool to function as a tool selected from the list comprising: a bit scraper, a bit mixer and a bit trowel spreader.

6. A combination multi-tool system comprising:

a first multi-tool comprising a surface edge comprising a rear edge, a top face, a bottom face, a left side, a right side, and a front edge forming a tip;

a relief configured to receive a coupler;

each of said rear edge, front edge, left side, and right side of said first multi-tool configured to perform a function necessary for performing work on a building element;

said first multi-tool being electively convertible into a shim element;

an attachment element configured to be selectively received about said tip of said front edge; and said attachment configured to integrate with said first multi-tool such that said attachment modifies said first multi-tool to perform a function for performing work on a building element.

7. The system of claim 6, further comprising:

a second multi-tool comprising a handle portion terminating in a head portion at a distal end thereof;

said handle portion terminating into a shank at a proximal end thereof;

said second multi-tool having a surface edge comprising a top face, a bottom face, a front end at said proximal end, a rear end at said distal end, a left side, and a right side;

said shank having a surface edge comprising a top face, a bottom face, a front end, a rear end, a left side, and a right side;

said shank comprising a coupler;

wherein said second multi-tool is configured to selectively temporarily engage with at least one accessory configured for performing work on a building element; and wherein said second multi-tool is configured to selectively temporarily engage with said first multi-tool such that said handle of said first multi-tool is configured to control said first multi-tool and said second multi-tool as a composite tool configured for performing work on a building element.

8. The system of claim 7, further comprising:

said first multi-tool comprising a pair of rails configured to guide and secure said coupler into said relief in a first, composite orientation; and said pair of rails further configured to receive said left and right sides of said second multi-tool in a second, stowed orientation.

9. The system of claim 8, further comprising a plurality of hash marks on at least one of said top face and said bottom face of said first multi-tool, said hash marks configured to be used as a measurement tool.

10. The system of claim 7, wherein said shank and said handle form a thirty-degree angle.

11. The system of claim 6, wherein said attachment is further configured to store additional tool elements configured for performing work on a building element.

12. A combination multi-tool system comprising:

a first multi-tool comprising a handle portion terminating in a head portion at a distal end thereof and terminating in a shank portion at a proximal end thereof, said first multi-tool further including a surface edge comprising a top face, a bottom face, a front end at said proximal end, a rear end at said distal end, a left side, and a right side;

a second multi-tool comprising a surface edge comprising a rear edge, a top face, a bottom face, a left side, a right side, and a front edge forming a tip;

at least one accessory element;

at least one storage container; and wherein said first multi-tool and said second multi-tool are selectively convertible between a first, stowed orientation with said first multi-tool secured within said second multi-tool, a second, independent orientation with the two multi-tools separated, and a third, composite orientation with said first multi-tool selectively engaged with said second multi-tool such that said handle portion is configured to control both said first-multi tool and said second multi-tool as a composite tool for performing work on a building element.

13. The system of claim 12, wherein said at least one storage container comprises a base portion comprising an interior space and a removeable lid.

14. The system of claim 12, further comprising:

a tool connector configured for being connected to said front edge of said second multi tool, said tool connector comprising at least one edge configured for performing a task; and said tool connector further configured for storing touch up tools within said tool connector.

* * * * *